US006758370B2

(12) United States Patent
Cooke et al.

(10) Patent No.: US 6,758,370 B2
(45) **Date of Patent: *Jul. 6, 2004**

(54) PRODUCT VENDING

(75) Inventors: Brian Cooke, Rosebud (AU); Mark Grondman, Upwey (AU); Alan Jenkins, Pearcedale (AU); Gerry Mussett, Elwood (AU); Magnus Cameron, Burwood (AU); Gower Smith, San Francisco, CA (US)

(73) Assignee: Imaging Technologies Pty Ltd., Victoria (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/485,118

(22) PCT Filed: Aug. 6, 1998

(86) PCT No.: PCT/AU98/00616

§ 371 (c)(1),
(2), (4) Date: Feb. 4, 2000

(87) PCT Pub. No.: WO99/08241

PCT Pub. Date: Feb. 18, 1999

(65) Prior Publication Data

US 2003/0062378 A1 Apr. 3, 2003

(30) Foreign Application Priority Data

Aug. 6, 1997 (AU) ..... PO8428

(51) Int. Cl.[7] ..... B65H 3/00
(52) U.S. Cl. ..... 221/194; 221/289
(58) Field of Search ..... 221/131, 129, 221/124, 268, 258, 289, 194, 191, 195, 251, 238, 1, 7, 13, 15

(56) References Cited

U.S. PATENT DOCUMENTS 3,502,382 A * 3/1970 Rainey ..... 221/251
5,111,962 A * 5/1992 Oden ..... 221/1
5,713,485 A * 2/1998 Liff et al. ..... 221/129

FOREIGN PATENT DOCUMENTS

| | | |
|---|---|---|
| FR | A723274 | 4/1932 |
| GB | A940913 | 11/1963 |

OTHER PUBLICATIONS

Patent Abstracts of Japan, JP 08–287348 A, Nov. 1, 1996.

Patent Abstracts of Japan, P1448, p. 127, JP 04–199296 A, Jul. 20, 1992.

* cited by examiner

*Primary Examiner*—Kenneth W. Noland
(74) *Attorney, Agent, or Firm*—Birch, Stewart, Kolasch & Birch, LLP

(57) ABSTRACT

A dispensing mechanism is provided for flat faced products. The products are supported in a storage chute between a first upright wall and a second upright wall, stacked one on top of another. The products are supported in the chute by a support surface and a first tongue. Products are dispensed by retracting the first tongue allowing a lowermost product to fall onto a second tongue. The first tongue is advanced to be under the next highermost product in the chute. The second tongue is then retracted allowing the lowermost product to fall onto the support surface and pass through a discharge opening. In a further embodiment, flat faced products are stacked vertically side-by-side on a slightly inclined floor. The products move horizontally to one side to be dispensed. A tongue and a moveable stop are mounted at that side. The spacing between the tongue and the stop is generally equal the thickness of the product. The product can be dispensed by retracting the tongue allowing all of the products to move to that side and making the mechanism ready to dispense the next product. The mechanism includes a sensor to detect when a dispensed product is removed from a delivery bin, and a process to credit a customer's account for a product not removed from the delivery bin.

29 Claims, 16 Drawing Sheets

PRODUCT VENDING

This application is the national phase under 35 U.S.C. §371 PCT International Application No. PCT/AU98/00616which has an International filing date of Aug. 6, 1998,which designated the United States of America.

FIELD OF THE INVENTION

This invention relates to product vending and relates particularly but not exclusively to product vending apparatus and parts therefor suitable for vending high cost products such as consumables for computer printers.

DESCRIPTION OF PRIOR ART

Hitherto, it has been known to provide vending apparatus for dispensing high cost product such as consumables in computer printing machines. Typical examples of prior systems are disclosed in our co-pending international patent applications nos. PCT/AU93/00416 (WO94/04446), and PCT/AU95/00154 (WO95/26004). The disclosures in those documents are herein incorporated by reference. PCT/AU93/00416 relates to a vending machine which facilitates recycling of complex articles, such as printer and toner cartridges. PCT/AU95/00154 discloses an electronic catalogue device and system for enabling remote ordering of goods/services.

With the ever-increasing models of printers on the market there is an increase in the number of products which are specific to particular printers. Each of these products is a relatively high unit cost product and it is desirable for a vending machine to stock as wide a range of product as possible. Hitherto, the vending mechanisms within such vending machines have limited the product range which can be stocked as the vending mechanisms have occupied a considerable space within the vending machine. Further, particular product which is to be dispensed such as reams of paper or other media on which printing is to be performed is relatively bulky and relatively heavy compared to, for example, printer cartridges, particularly inkjet printer cartridges. Thus, if a vending machine is to dispense heavy articles of this type, the known prior art dispensing mechanisms have been unsuitable as the vending mechanisms cannot handle the large relative weight of such articles.

OBJECT AND STATEMENTS OF THE INVENTION

The present invention attempts to address one or more of the afore-mentioned problems.

Therefore, in accordance with a preferred aspect of the present invention, there may be provided a dispensing mechanism for a vending machine for permitting generally flat faced product to be vended one at a time, said mechanism comprising an upright storage chute in which identical shaped and sized product can be stacked one on top of the other so the flat face of said generally flat faced product lies generally transversely of vertical, said storage chute being defined by a first generally upright extending wall and a spaced and opposed second generally upright extended wall, the spacing being sufficient to allow the product to move in a generally vertical path in said chute by gravity from the top to the bottom of the chute, there being an inclined product discharge ramp extending downwardly across said chute towards a product discharge opening in said second wall, there being a first tongue and a vertically lower spaced second tongue mounted to advance and retreat into said path through said second wall at the bottom of the stack, a lowermost product being supported in said chute by a support surface in said path opposite where said first tongue extends through said second wall and by said first tongue when said first tongue is advanced into said path through said second wall, the weight of all products being carried by said support surface and said first tongue, there being movement means to permit said second tongue to retreat when said first tongue is advanced, and to permit said second tongue to be advanced when said first tongue is retreated, so said second tongue will catch a lowermost edge of the lowermost product as it falls past said first tongue when said first tongue is retreated and so said lowermost product will then be supported in said chute by said support surface and by said second tongue, the vertical spacing of said first tongue and said second tongue being such that when the lowermost product is caught by the second tongue, the next highermost product in the stack will be positioned so that the first tongue can be advanced under that product so that that product and all products thereabove will be carried by said upper part of said inclined ramp and said first tongue, and so as said second tongue is retreated the product caught on said second tongue will fall by gravity onto said inclined ramp and pass through said discharge opening and be vended.

It is particularly preferred that said first tongue and said second tongue be mechanically interconnected for pivoting rocking movement for advancing and retreating and that the pivot axis be generally horizontal.

It is particularly preferred that solenoid means be connected to said first tongue and to said second tongue to effect advancing and retreating.

It is particularly preferred that said support surface be an upper part of said inclined ramp.

It is also particularly preferred that said inclined ramp have a step at the upper part so that product supported by said first tongue and said upper part be supported at an upper part of said step, and so product supported by said upper part and said second tongue be supported at a lower part of said step.

It is also particularly preferred that said storage chute be one of a plurality of chute modules, and that each module be positioned one above the other to form a multiple module height chute so that a plurality of different products can be stacked in said multiple height chute and vended therefrom by advancing or retreating the appropriate first and second tongues.

It is particularly preferred that said multiple height chute be a single chute with bays for each module and wherein the plurality of discharge openings be coverable by respective removable wall plates, that said plurality of first tongues and said second tongues be removable, and that said inclined ramps be removable, whereby a product vendor can choose to utilise the whole of the chute for one group of product in a range, or can utilise the chute for a plurality of different product groups in a range, thereby permitting multiple groups of products to be stacked in said chute and user selected for vending by operation of the corresponding first tongue and second tongue.

It is particularly preferred that said inclined ramp be of unitary construction but it may comprises two or more separate items. In this instance there may be a first item which defines the upper part of said ramp and a second or more items which define a lower part. In this way, the first item may extend from or adjacent said first wall and the second item may extend from or adjacent a lower part of said upper part of said ramp.

It is particularly preferred that said ramp be swingable about its upper region so that when loading fresh product into said chute, said ramp can be swung by its lowermost part swinging upwardly to a generally horizontal position thereby closing the chute at the bottom of the chute and inhibiting against mis-oriented product falling through the chute and being discharged from said product discharge opening.

According to a further broad aspect of the present invention there may be provided a vending machine having a plurality of chute modules, each module having an upright extending chute in which identical shaped and size product can be stacked one on top of the other, said storage chute being defined by a first generally upright extending wall and a spaced and opposed second generally upright extending wall, the spacing being sufficient to allow the product to move in a generally vertical path in said chute by gravity from the top to the bottom of the chute, there being an inclined product discharge ramp extending across the bottom of the chute extending downwardly from adjacent the first wall to the second wall, and a product discharge opening in said second wall, there being a product dispensing mechanism at the bottom of the chute above said ramp, said product dispensing mechanism permitting the lowermost product in said chute to be vended by moving onto said ramp and passing through said opening whilst retaining all product higher than said lowermost product within said chute for subsequent vending, each module being positioned one above the other whereby to provide a multiple module height chute so that a plurality of different products can be stacked in said multiple height chute and vended therefrom by advancing or retreating the appropriate first and second tongues.

It is particularly preferred that said multiple height chute be a single chute with bays for each module and wherein the plurality of discharge openings be coverable by respective removable wall plates, said plurality of first tongues and said second tongues be removable, and that said inclined ramps be removable, whereby a product vendor can choose to utilise the whole of the chute for one group of product in a range, or can utilise a chute for a plurality of different product groups in a range, thereby permitting multiple groups of product to be stacked in said chute and user selected for vending by operation of the corresponding first tongue and second tongue.

It is particularly preferred that said ramp be swingable about its upper region so that when loading fresh product into said chute, said ramp can be swung from its lowermost part upwardly to a generally horizontal position thereby closing the chute at the bottom of the chute and inhibiting against mis-oriented product falling through the chute and being discharged from said product discharge opening.

According to a further broad aspect of the present invention there may be provided a vending machine for vending product, said machine having a processing means, a user operable product selecting means, a dispensing mechanism for releasing stored product one at a time so said stored product can be vended, a product sensing means for sensing product dispensed from said dispensing mechanism and a product removal sensor, all being functionally interconnected and controlled by software so that as product is dispensed from said dispensing mechanism in response to user operation of said user operable product selecting means, said product will be sensed as being dispensed by said product sensing means and so that as product is removed from said vending machine after being dispensed from said dispensing means it will be sensed by said product removal sensor, and said software will be invoked to permit acknowledgment of a vended product, and if said product removal sensor does not sense corresponding product removal following product dispensing sensing, then identifying either jammed product or user unretrieved product.

Preferably said product sensing means for sensing product dispensed comprises a physical sensor in the path of the product as it is dispensed.

In another embodiment said product sensing means may simply comprise providing a sensing signal in response to the user operable product selecting means being activated to dispense a product.

Preferably, said machine has a multiple product vending feature, where multiple product can be ordered to be vended by a single purchase transaction at said machine, and wherein if said product removal sensor is not activated, the order will be terminated without dispensing of subsequent product in that order.

Preferably, said machine has a credit card debit facility for charging for product dispensed, and wherein multiple product ordered to be vended by a single transaction is charged to said credit card, and wherein if said product removal sensor is not activated, the order will be terminated without dispensing of subsequent product in that order, and the credit card debit adjusted to reflect the cost of any product removed from said machine in that order.

According to a further broad aspect of the present invention there may be provided a dispensing mechanism for a vending machine for permitting generally flat faced product to be vended one at a time, said mechanism comprising a storage bin with a generally horizontally extending but inclined floor on which said generally flat faced product can be supported on an edge face so that flat face extends generally upright and wherein product can be stacked side-by-side, and wherein the product can move in a generally horizontal path across said floor by gravity from an uppermost side of said floor to a lowermost side of said floor, there being a tongue mounted to advance and retreat into said path through said floor at the lowermost side of said floor, and a movable stop at the end of the floor at the lowermost side, the spacing between said tongue and said stop being such that a single product can be supported on the floor in said space and prevented from falling by gravity from said floor by said stop, and wherein said tongue is advanceable into said path to prevent movement of the next product in said path, so that when product is to be vended said stop can be moved away from the end of the floor thereby allowing the product to fall by gravity and to be vended, and to permit product held in said path by said tongue, and so that after vending said stop can be returned to the end of the floor and the tongue retreated thereby allowing the next product to move into said space between said tongue and said stop whereupon said tongue can then be advanced between the next product and the succeeding product making the machine ready for future vending.

Most preferably said movable stop is an end wall of said storage bin.

Most preferably said end wall is pivoted near the top of said storage bin so it can swing from a position where it is at the end of said floor to a position away from said floor.

Most preferably there is a latch for holding said end wall at the position where it is at the end of said floor and wherein when said latch is released, the weight of product will cause said end wall to swing to said position away from said floor and to allow the product to fall by gravity off said floor, and wherein said latch can relatch said end wall as it return swings by gravity to the end of said floor.

Preferably, the end wall is mounted so it will return swing by gravity.

BRIEF DESCRIPTION OF THE DRAWINGS

In order that the invention can be more clearly ascertained, an example of a preferred embodiment for dispensing computer printer consumable product will be described with reference to the accompanying drawings wherein.

DETAILED DESCRIPTION OF PREFERRED EMBODIMENT

Figure 1:
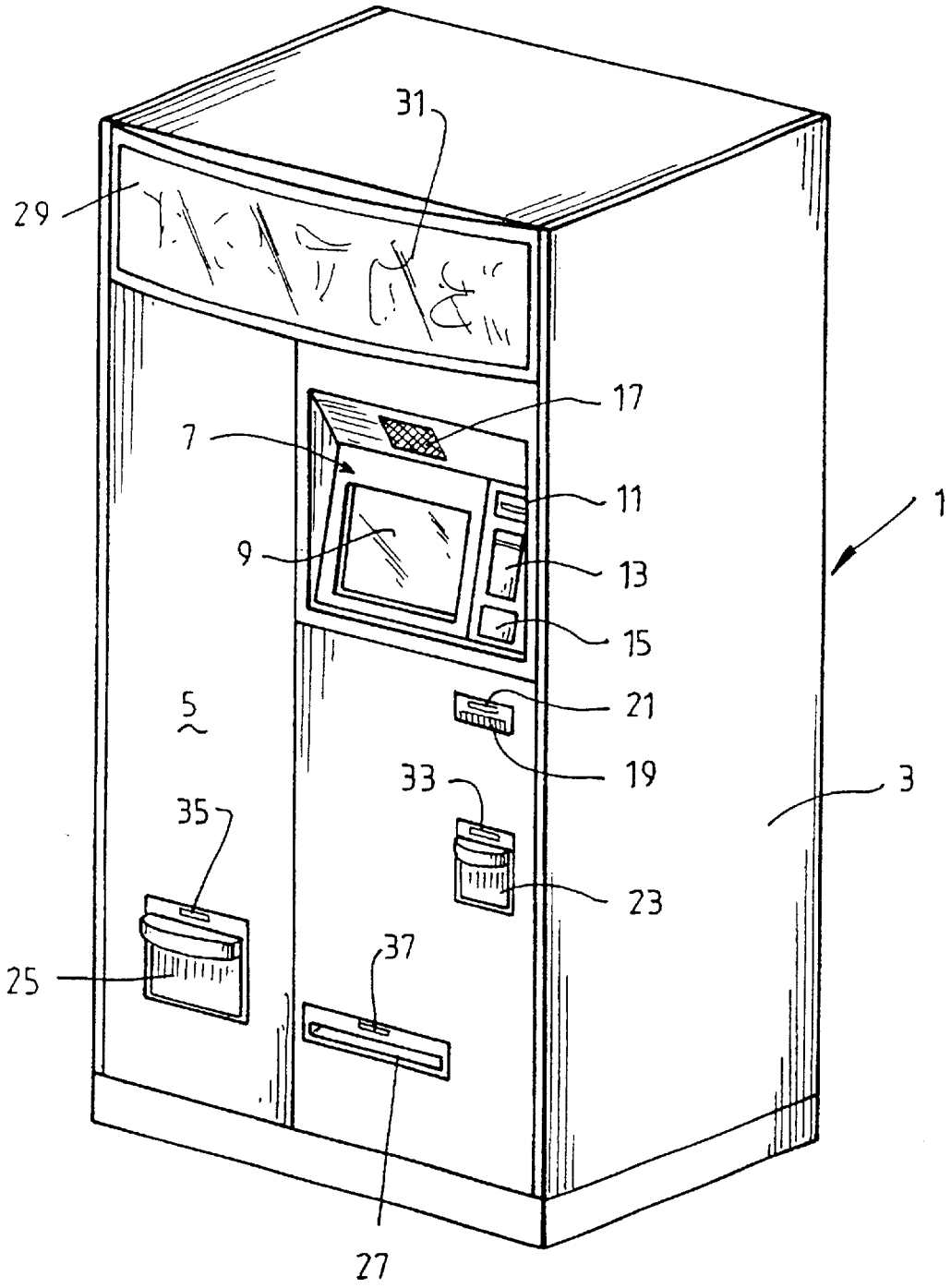
FIG. 1 is a front perspective view of the example of the preferred dispensing machine.

Referring firstly to FIG. 1, there is shown a vending machine 1 having a cabinet 3 made from sheet metal or other suitable material. The cabinet 3 is generally rectangular in footprint and stands upright. The front face 5 is provided with a user-interactive panel 7 which is preferably on a vertically inclined face. Panel 7 has a monitor screen 9 on which can be displayed messages and instructions and also a touch keyboard for alphanumeric data entry. In the upper right hand corner of panel 7 there is provided a motorised card reader 11 for reading credit cards and other similar cards. Below the card reader 11 is a "secure" PIN pad 13 for data entry of PIN numbers for a credit card introduced into the card reader 11. Mounted below the PIN pad 13 is a bar code scanning device 15. This can be used to scan bar code on existing product which the purchaser may already have on hand. In this way, particular product items can be selected by bar code scanning the bar code on the product held by the purchaser. Alternatively, screen displays may be provided on the monitor screen 9 to permit particular products to be chosen for vending. The screen 9 is configured as a touch screen so that menu options and product choices can be made directly by touching appropriate icons on the screen 9.

Mounted above the panel 7 is a loudspeaker device 17 from which audible announcements may be made concerning products to be vended and/or from which music or other pleasant sounds may be emitted to attract purchasers to the machine. Mounted below the panel 7 is a receipt printer 19. A series of LED lamps 21 are provided above the receipt printer 19 and these are illuminated at an appropriate time to announce to a purchaser that a receipt is being printed and ready for collection. Mounted directly below the receipt printer 19 is a door 23 which can be opened to enable recycling of used printer product such as printer ink cartridges. The door 23 may be latched and opened in response to particular user commands on the touch screen 9. In this way, the door will not be readily opened for receipt of items until requested by a particular purchaser. This will, in turn, inhibit against unwanted articles being blatantly deposited in the recycle bin.

At the bottom of the left hand side of the front face 5 is a door 25 which can be swung open about a lowermost hinge to permit retrieval of product vended from the vending machine 1. In this example, the product which is passed through the door 25 is printer ink cartridges such as inkjet cartridges. Mounted on the lower right hand side of the front face 5 of the vending machine 1 is a slot 27 through which a purchaser can place their fingers or hands to enable retrieval of further product vended from the vending machine 1. In this case, the product vended through slot 27 is typically media material such as printing paper, envelope paper and the like. Mounted at the top of the front face 5 is a light box 29 with a front face 31 on which advertising material may be displayed. Typically, the front face 31 is provided by a plastic sheet suitably printed with desired advertising material.

Mounted within the cabinet 3 are a number of dispensing mechanisms for dispensing product as selected by a purchaser from operation of the control panel 7. The machine 1 also has an in-built computer device for controlling operation of the machine. It also has a modem for permitting connection to a host computer to relay information backwards and forwards concerning operation of the machine such as stock held details, stock purchase details and/or whether there is a malfunction in the machine.

Mounted above door 23 are a series of LEDs 33 which are illuminated when the latch on the door 23 is released. This permits a purchaser to be informed when the door 23 can be opened.

Mounted above door 25 are a series of LEDs 35 which can be illuminated when a product is vended within the machine and ready for collection by being withdrawn through door 25. This also permits a purchaser to be informed that vended product is ready for collection.

Mounted above slot 27 are a series of LEDs 37 which can be illuminated when product has been vended within the machine and is ready for collection by being withdrawn through the slot 27. This also permits a purchaser to be informed that vended product is ready for collection.

Referring now to FIGS. 2 through 9, there is shown detail of a dispensing mechanism for dispensing articles through door 25. Such mechanism may be one of several such mechanisms mounted within the cabinet 3 on the left hand side when viewing FIG. 1. The product which is to be dispensed in this particular example comprises inkjet printer cartridges. The inkjet printer cartridges are shown throughout these figures within an outer product package 37. This package has a generally flat face 39 which is arranged to be on the underside of the product 37. This particular product also has a flat upper face 41 with two flat side faces 43 which are inclined. The transverse cross-section of the pack is therefore tetrahedral in shape. The product 37 is stacked within an upright storage chute 45 so that the product 37 lies one on top of the other and so that the flat face 39 lies generally transversely of vertical. All of the product 37 is therefore identically shaped and sized.

The chute 45 is defined by a first generally upright extending wall 47, and a spaced and opposed second generally upright extending wall 49. The spacing of the first wall 47 and the second wall 49 is sufficient to allow the product 37 to move in a generally vertical path 51 in the chute 45 by gravity from the top to the bottom of the chute 45. In the example shown, the flat face 39 is slightly inclined off true horizontal and slopes downwardly from the second wall 49 towards the first wall 47.

Mounted within the chute 45 is a product discharge ramp 53 which extends downwardly across the chute 45 from the first wall 47 to the second wall 49 towards a product discharge opening 55 in the second wall 49.

Figure 2:
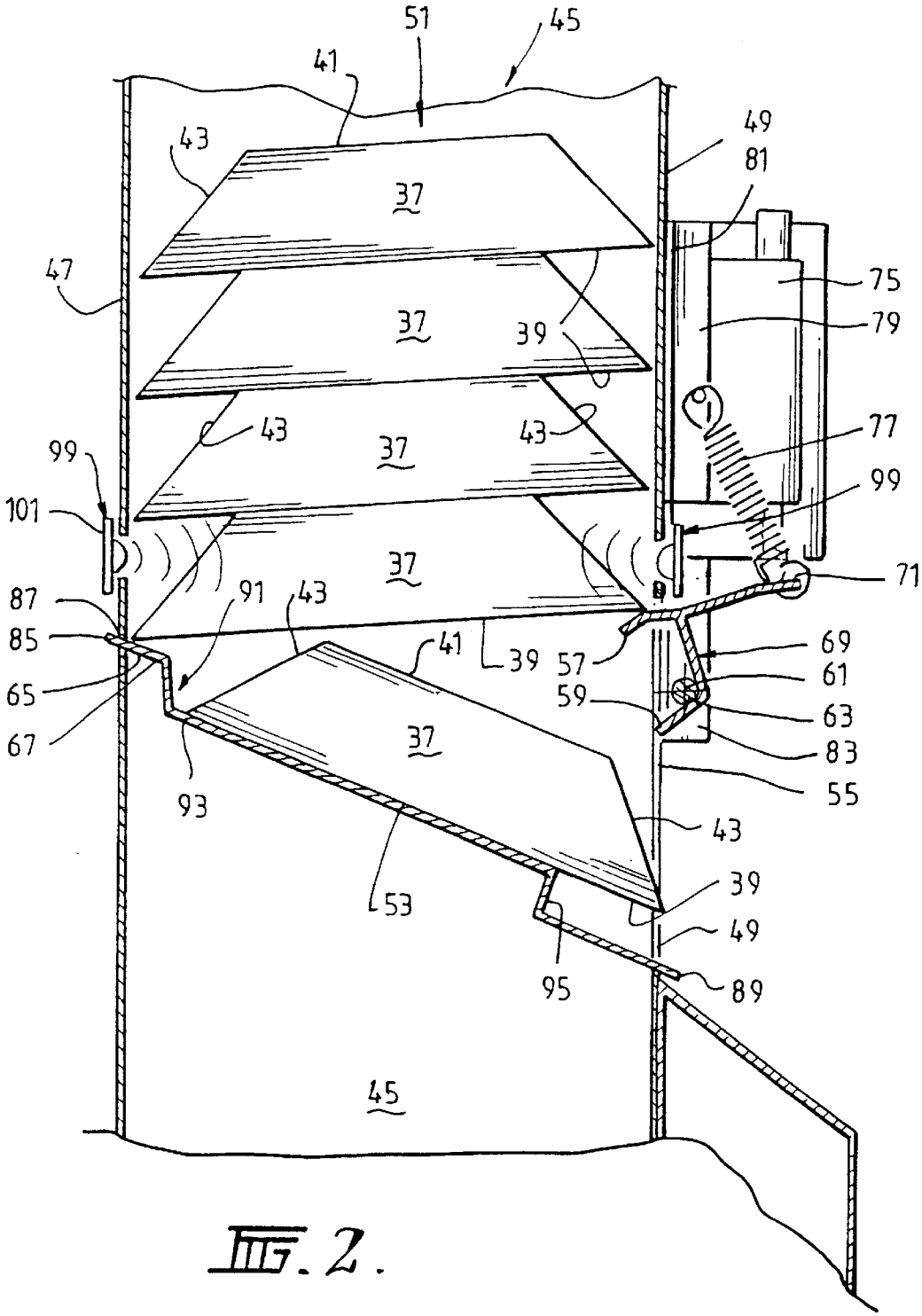
FIG. 2 is a side view of a dispensing machine for dispensing flat faced product such as inkjet printer cartridges.

The dispensing mechanism has a first tongue 57, and a vertically lower spaced second tongue 59 mounted externally of the chute 45 adjacent the second wall 49 so that both the first tongue 57 and the second tongue 59 can advance and retreat into the path 51 through the second wall 49 at the bottom of the stack of product 37. In this example, the first tongue 57 and the second tongue 59 are mechanically interconnected for pivotal rocking movement for advancing and retreating into the path 51 about a pivot axis 61 defined by a pivot pin 63. The pivot axis 61 is arranged to be generally horizontal and parallel with the face of the second wall 49. With the first tongue 57 extended into the path 51 as shown in FIG. 2, the lowermost product 37 in the stack is supported in the chute 45 by the first tongue 57 and by a support surface 65 in the path 51 which is opposite where the first tongue 57 extends through the second wall 49. In this example, the support surface 65 be an upper part 67 of the ramp 53. Thus, when the lowermost product 37 in the stack is supported in this way, all product stacked above the lowermost product will be similarly supported and thus the weight of all the product 37 in the stack will be carried by the support surface 65 and by the first tongue 57. Accordingly, the position shown in FIG. 2 represents a static position for the vending machine 1 whilst product 37 is not being dispensed.

Figure 7:
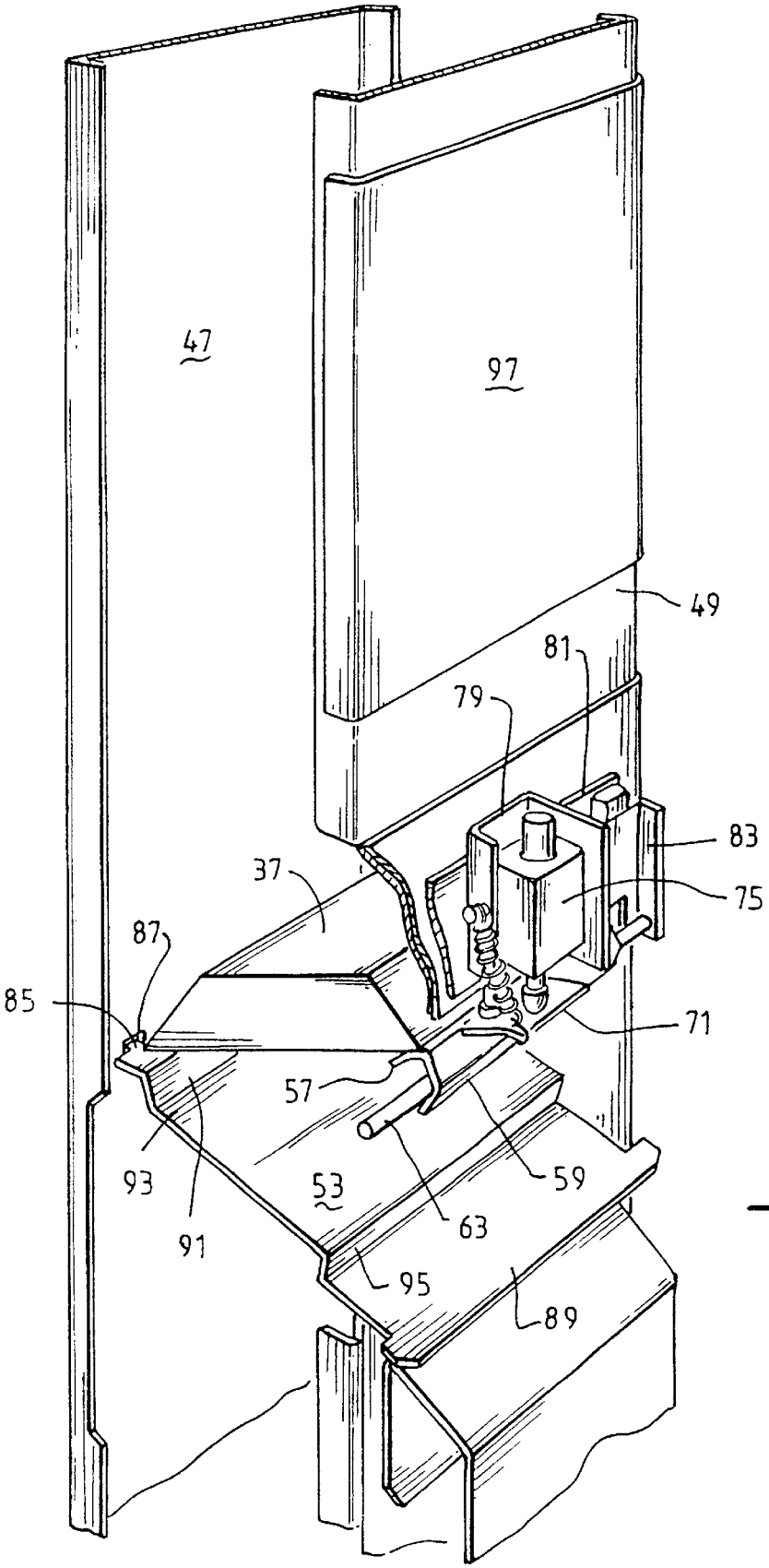
FIG. 7 is a perspective view similar to FIG. 3 showing a removable product discharge opening cover.

FIG. 2 clearly shows that the first tongue 57 and the second tongue 59 are interconnected by an arm 69 and that the pivot pin 63 is mounted generally at the junction of the second tongue 59 with the arm 69 and is therefore closer to the second tongue 59 than the first tongue 57. A further arm 71 extends from the junction between the first tongue 57 and the arm 69. The arm 71 extends outwardly from the second wall 49 so that it can be engaged by a head 73 of a solenoid-operated plunger 75. The arm 71 is maintained in close contact relationship with the head 73 by means of a spring means 77. The spring means 77 connects with a free end of the arm 71 and with a base part 79 forming part of a mounting bracket 81 on which the solenoid plunger 75 is supported and, in turn, attached to the second wall 49. The base 81 extends downwardly and provides a support for the pivot pin 63 but the figures do not clearly show this. FIG. 7 show this in diagrammatic form where an upturned arm 83 is provided through which the pivot pin 63 can extend and provide bearing support therefor. A similar arm 83 is provided at the opposite side of the base 81 for the other end of the pivot pin 63.

Figure 3:
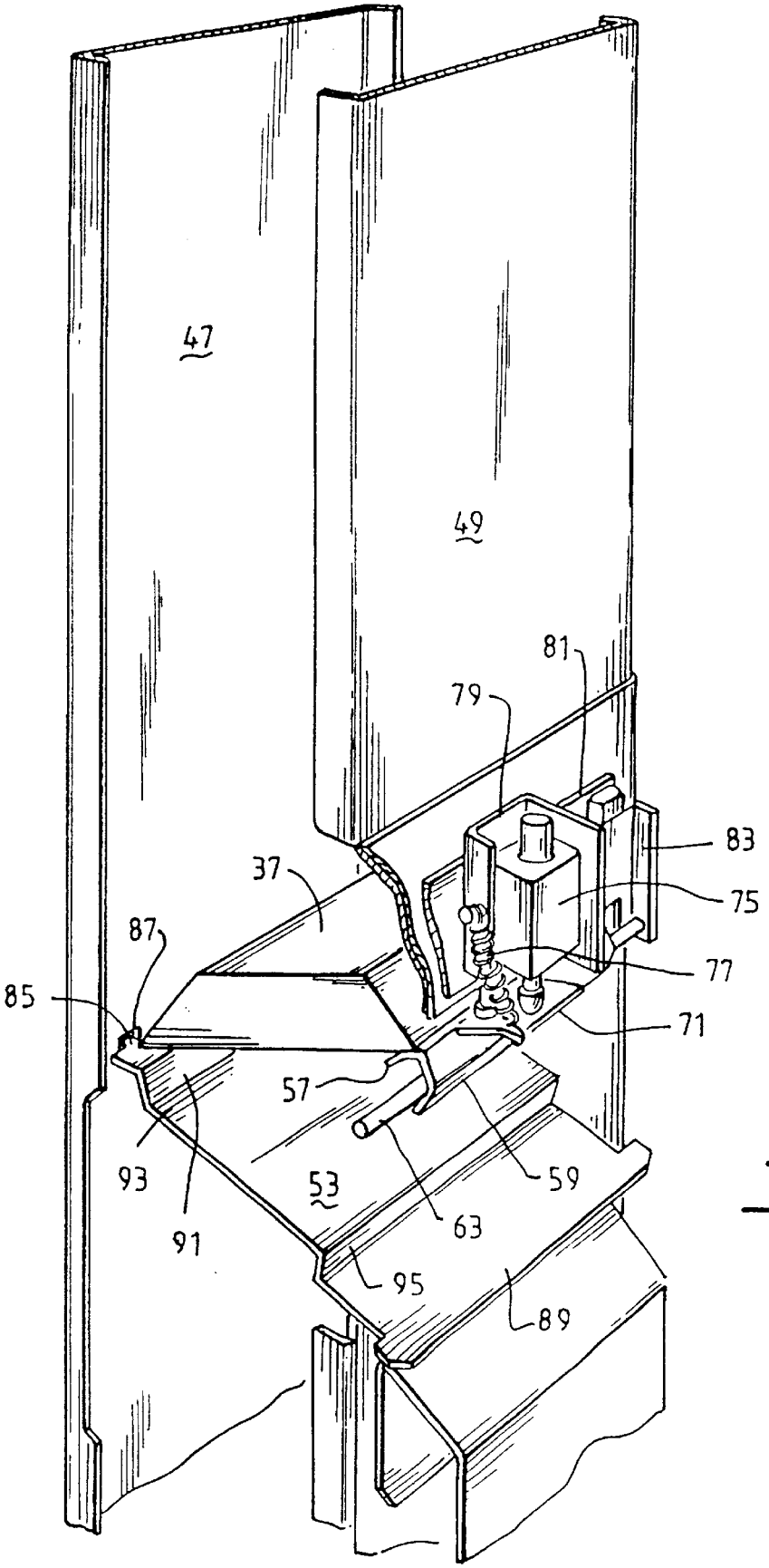
FIG. 3 is a perspective view of the mechanism of FIG. 2.

FIGS. 3 and 7 both show the nature of the ramp 53 which comprises a plate-like member which has two tongues 85 extending from the upper edge in spaced apart relation. Only one such tongue can be clearly seen in these figures. One tongue is on one side of the ramp 53 whilst the other tongue is on the opposite side. The tongues 85 are arranged to pass through apertures 87 in the first wall 47. This correctly releasably positions the ramp 53 relative to the first tongue 57 and the second tongue 59. It also provides a means for hinging of the ramp 53 so that it can swing from the position shown in these figures to a position where the lowermost part 89 can be swung upwardly to a generally horizontal position thereby closing the chute 45 at the bottom of the chute or the stack of product 37. This is particularly useful during loading of product 37 into the chute 45 as it prevents any mis-oriented product falling through the chute 45 and being discharged through the product discharge opening 55. Thus, it is an aid to loading and restocking of the vending machine. Catch means (not shown) may be utilised to hold the ramp 53 in that upwardly swung position during loading thereby leaving both hands of a restocker person free for the reloading purposes.

The ramp 53 is shown of unitary construction but it may comprise two or more separate items. In this instance, there may be a first item which defines the upper part 67 of the ramp and, in turn, the support surface 65. Thus, the first item may extend from or adjacent the first wall 47, and the second item may then comprise a generally downwardly inclined ramp surface which may extend from or adjacent a lower part of the upper part 67. In this way, the upper part 67 will define the surface 65 which supports the undersurface and flat face 39 of the product 37 and the lower part will then provide a ramp surface to direct dispensed product downwardly through the product discharge opening 55.

The ramp 53 is shown having a step 91 at the upper part 67. In this arrangement, the product 37 initially has its flat face 39 supported on the upper part of the step 91. The step 91 has a lower surface 93 onto which the product can fall. The lower surface 93 also provides a further supporting surface for a product being discharged as will be described hereinafter. The ramp 53 also has a step 95 at a lower part which assists free discharge of the product 37 off the ramp 53.

Figure 4:
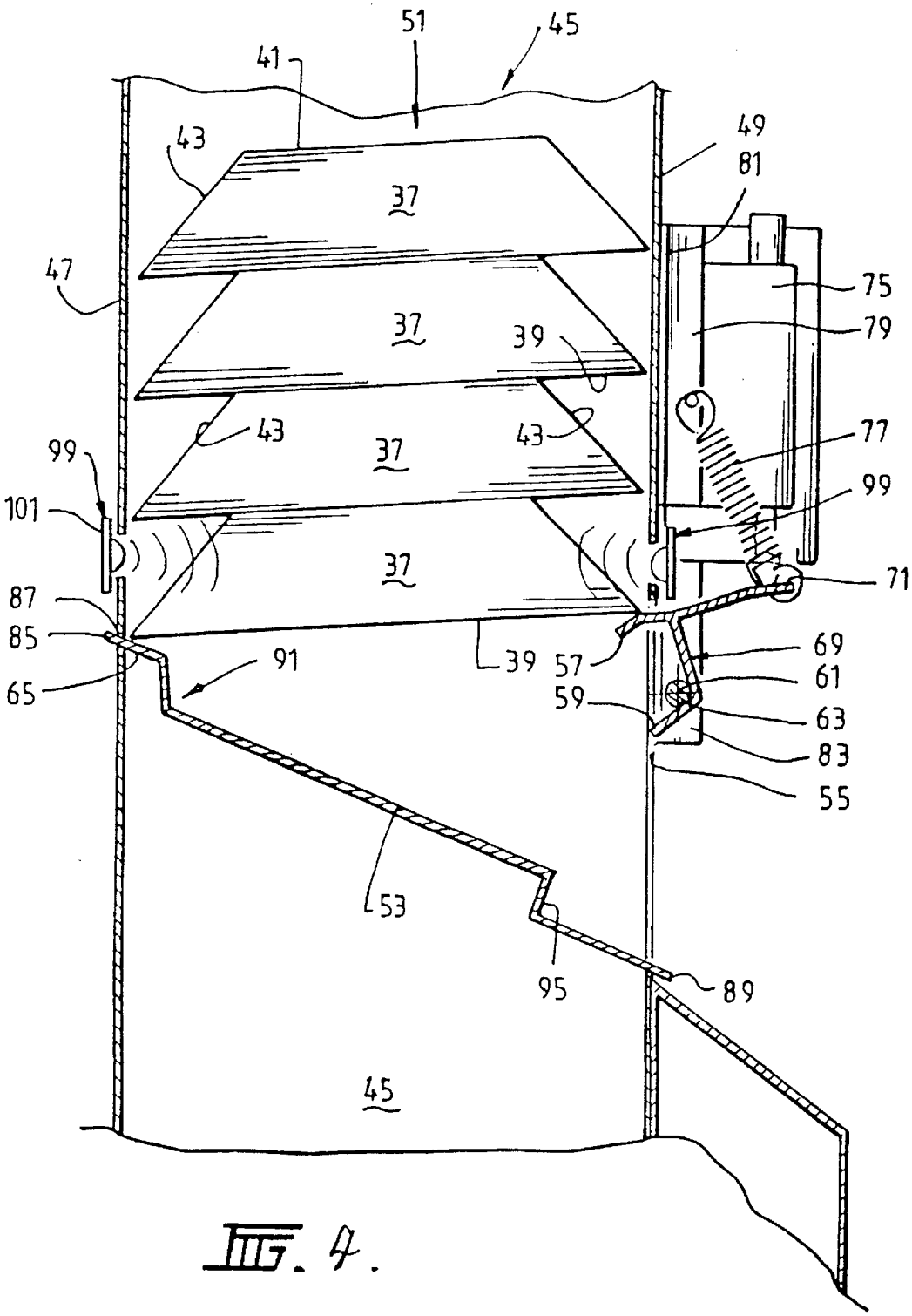
FIGS. 4, 5, and 6 are views similar to FIG. 2 showing different stages of operation.
Figure 5:
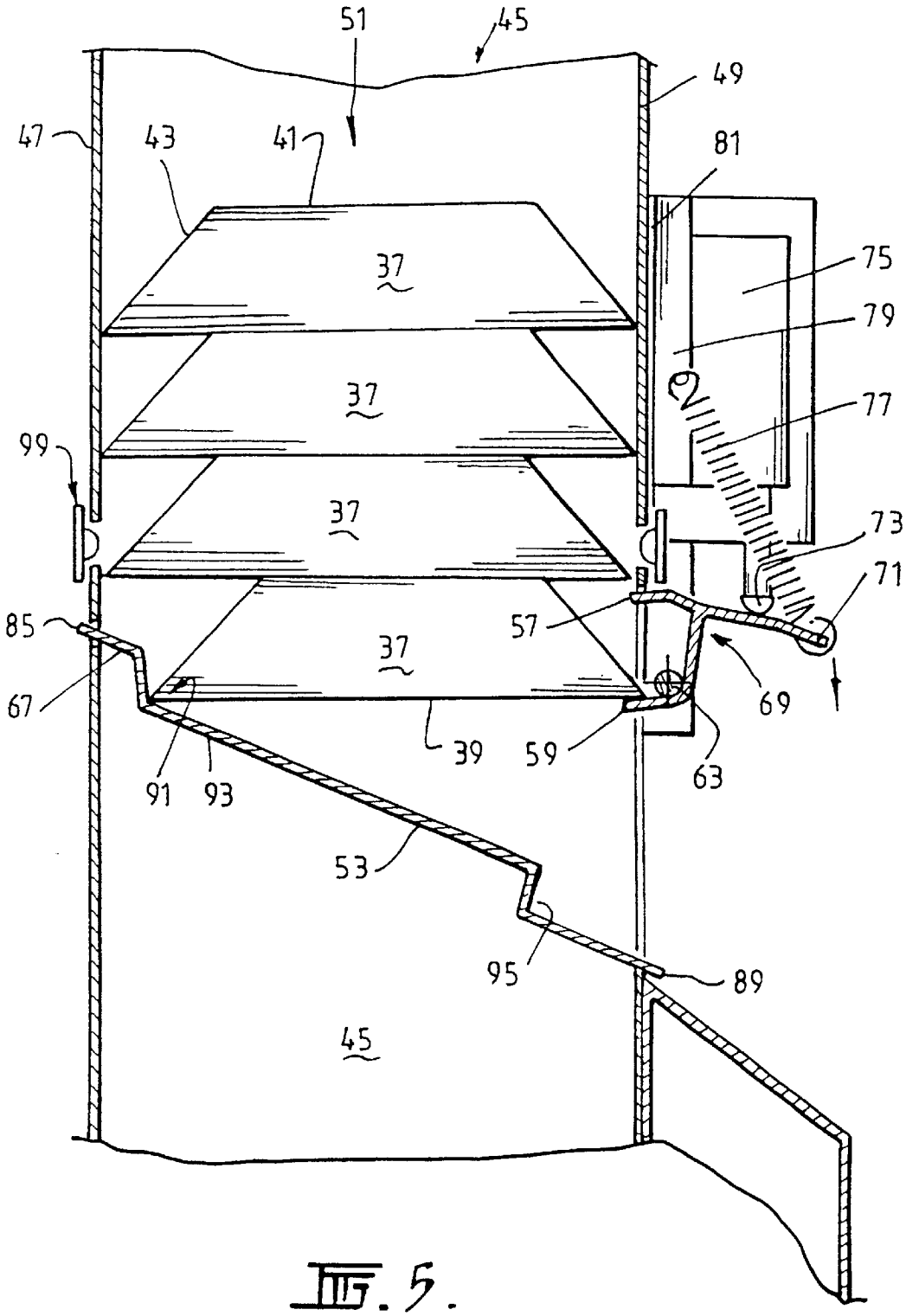
Figure 6:
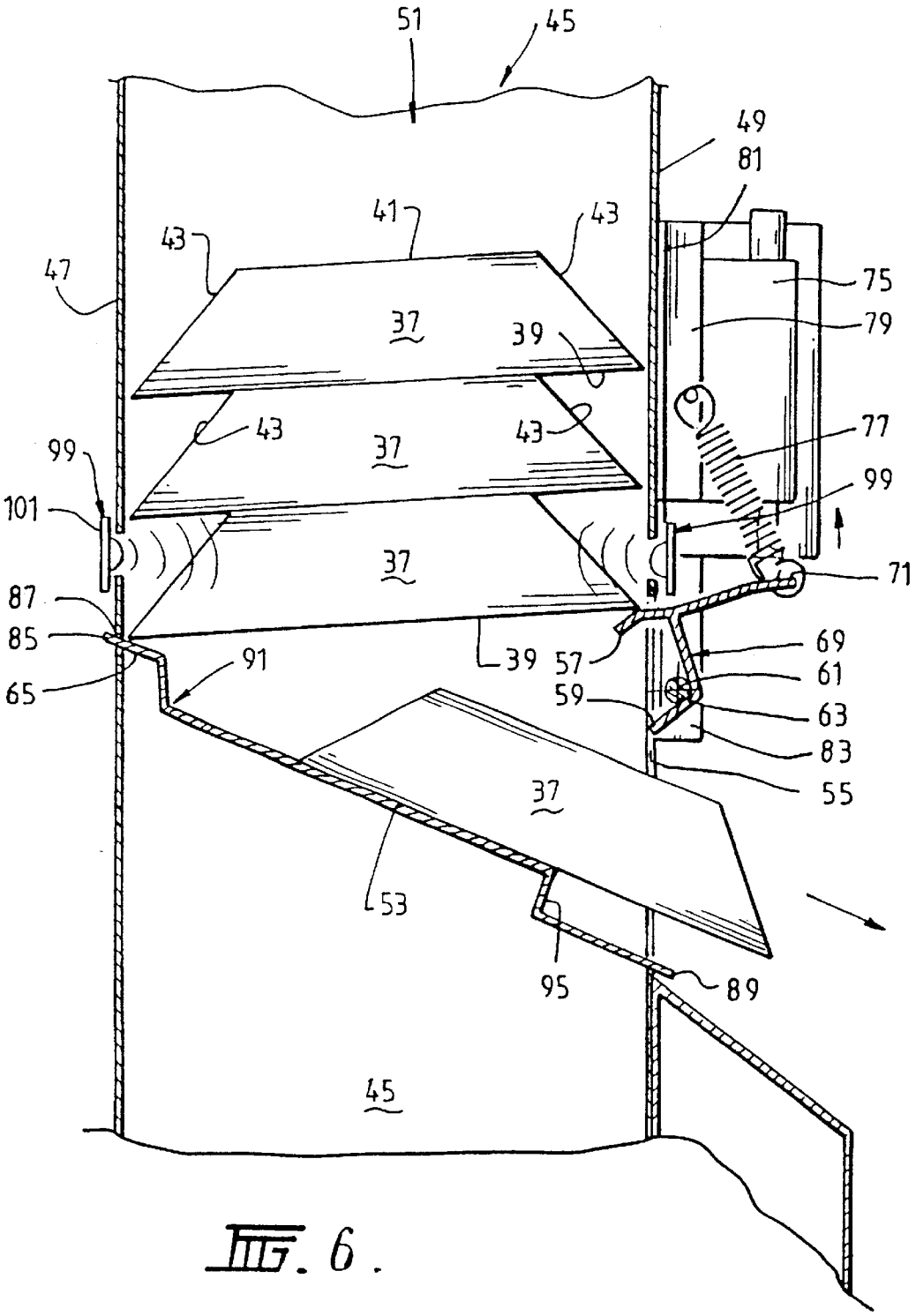

Referring now to FIGS. 4, 5, and 6, it can be seen, particularly in FIG. 4, that the product 37 is supported in the chute 45 by the support surface 65 and by the first tongue 57. The weight of all products 37 is also carried by the support surface 65 and the first tongue 57. FIG. 5 shows a first step in dispensing the product 37. Here, the solenoid 75 is operated in response to a user request for dispensing product. This, in turn, causes the solenoid plunger to extend so that the head 73 pushes arm 71 downwardly as shown by the arrow. This causes the first tongue 57 to retreat from the path 51 and causes the second tongue 59 to advance into the path 51. The spring means 77 is extended during this operation. When the first tongue 57 clears the edge of a product 37, the product 37 falls by gravity downwardly in the path 51. All product above the lowermost product follows. The lowermost product 37 is then caught by the advanced second tongue 59. Because the lowermost surface or flat surface 39 is slightly downwardly inclined towards the support surface 65, the product 37 is initially maintained on the upper part 67 of the ramp 53. However, when the lowermost product is caught by the advanced second tongue 59, the flat face 39 is then downwardly inclined towards the second tongue 59. This, in turn, allows the product 37 to displace generally towards the second wall 49 and for the opposite end of the product 37 to move to the lower surface 93 of the step 91. Accordingly, at this instant, the lowermost product 37 is supported by the lower surface 93 and by the second tongue 59. All higher product 37 in the stack then rests on the top of one another on the lowermost product 37 and therefore the weight of all product 37 in the stack is carried by the lower surface 93 and by the second tongue 59.

The vertical spacing of the first tongue 57 and the second tongue 59 is such that the next highest product 37 in the stack will be positioned so that its flat face 39 will be aligned relative to the first tongue 57, so that when the first tongue 57 is advanced into the path 51 it will pass under that surface 39. At this point of time, the second tongue 59 can be retreated and the first tongue 57 can be advanced. This action, by rocking of the interconnected first tongue 57 and second tongue 59, occurs when the solenoid 75 is released as shown in FIG. 6 and so that the arm 71 moves in an upward direction as shown. The spring means 77 enables the swinging motion to occur by pulling on the arm 71 to, in turn, swing the first tongue 57 and the second tongue 59 about the pivot axis 61.

Thus, as the second arm 59 clears the edge of product 37, the product 37 will fully engage on the ramp 53 and slide downwardly to be discharged through the discharge opening 55. All further product 37 in the chute 45 will then again be supported by the support surface 65 and by the first tongue 57. The swinging/rocking movement of the interconnected first tongue 57 and second tongue 59 coordinates the release of product 37 and the subsequent catching and holding of the next higher product 37 in the stack. The above arrangement allows product 37 to be dispensed one at a time from the dispensing mechanism.

The above dispensing mechanism enables itself to be modularised so that for a single chute 45 there may be provided a number of such modules. Thus, the second wall 39 may have discharge openings 55 at preselected positions. The first wall 47 may have pre-punched apertures 87 at positions opposite the discharge openings 55. In this way, a vendor can choose to use a whole chute 45 to dispense a particular product 37 from all the contents in the chute 45 or may decide to break the chute 45 into a series of modules so that groups of different products can be carried in the chute 45 and be appropriately dispensed. Thus, each module or group is then positioned one above the other whereby to provide a multiple module height chute so that a plurality of different products 37 can be stacked in the multiple height chute and vended therefrom by advancing or retreating appropriate first tongues 57 and second tongues 59. Thus, as shown in FIGS. 2, 3 and 7, the first tongue 57 and second tongue 59 are mounted as a module on base 81. Similarly, the solenoid 75 is carried on its base part 79 which, in turn, is attached to the base 81. All bases 81 can therefore be mounted adjacent appropriate discharge openings 55, and corresponding ramps 53 inserted through the apertures 87. In this way, the product 37 in each group will then be supported by the respective support surface 65 and the corresponding first tongue 57 or second tongue 59. Cover plates 97 (see FIG. 7) are provided to pass over the second wall 49 and cover the respective product discharge openings 55 if the particular discharge opening 55 is not to be utilised for discharge of product. In this way, the discharge openings can be covered and enable product 37 from a lowermost module to extend therepast in the chute 45 and fall by gravity past that discharge opening 55 to be vended from the particular discharge opening 55 for that module. The cover plates 97 are therefore removable and can be held in place by appropriate screw means (not shown). The arrangement permits multiple groups of product to be stacked in the chute 45 and user selected for vending by operation of the corresponding first tongue 57 and second tongue 59.

In an alternative construction each module may be an integral unit which can be mounted on top of another similar module, thereby providing a single column made from individual modules stacked one on top of each other. Such arrangement means that a single module can be manufactured with economies of manufacture and by providing an appropriate number of such modules stacked one on top of the other dispensing of a corresponding number of different products can be achieved. This obviates the need for manufacture and stacking of different height sized modules. If it is found that a particular module is of insufficient height for the numbers of product to be stored then a simple chute infill module without any of the dispensing mechanism can be provided. This also reduces manufacturing costs relative to a plurality of complete different sized modules with integral dispensing mechanisms.

Figure 8:
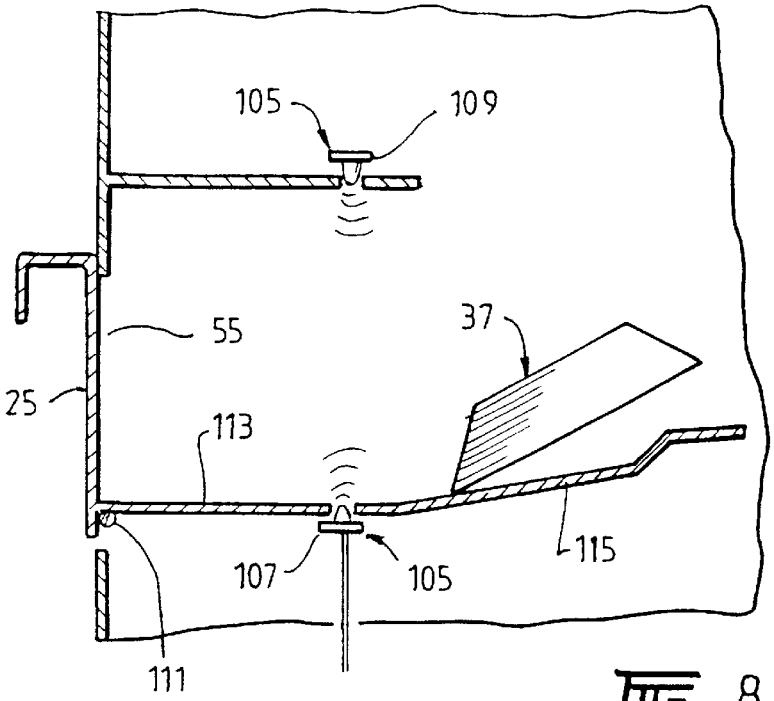
FIG. 8 is a side view of a product retrieval sensor arrangement.
Figure 9:
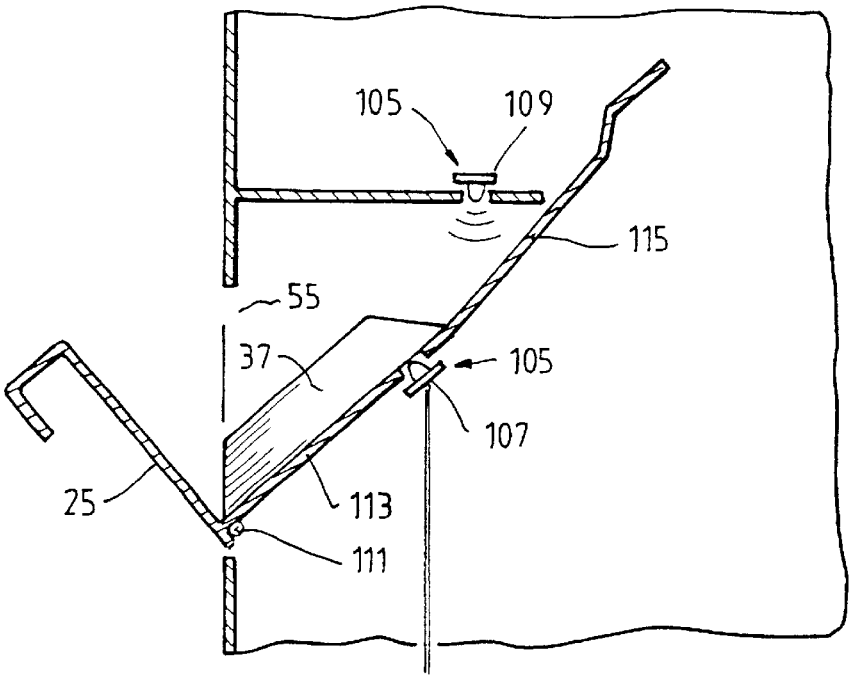
FIG. 9 is a view similar to FIG. 8 showing the product retrieval sensor at a different stage of operation.

FIG. 2 and FIGS. 4, 5, and 6 show product sensing means 99 comprising LED 101 and photo-responsive pick-up 103. This product sensing means 99 is utilized to sense that a product is being dispensed from the dispensing mechanism. During falling of the lowermost product 37 onto the second tongue 59, a beam of light transmitted from LED 101 to pick-up 103, will signal product movement 37 in the path 51. This signal will be utilised to set a condition in a computer control system of the machine. FIGS. 8 and 9 show a product removal sensor 105 comprising an LED 107 and a pick-up sensor 109. The removal sensor 105 is positioned adjacent the door 25 so that when a product 37 is removed from the vending machine, the product will trigger operation of the removal sensor 105 and provide a further set condition to the computing means. FIGS. 8 and 9 show that the door 25 is hinged at its lowermost edge by a hinge pin 111. The door 25 is interconnected with a swinging floor 113. Thus, as a product is discharged through the discharge opening 55 it falls onto a rear part 115 of the floor 113. LEDs 35 above the door 25 can be illuminated to signal to a purchaser using the vending machine that the product 37 has been dispensed and is ready for removal. Thus, the door 25 can then be swung open which, in turn, raises the floor 113 and causes the product 37 to fall past the removal sensor 105 for subsequent collection by the user. This set condition then invokes software within the computer to permit acknowledgment of a vended product. If the set condition signalled by the removal sensor 105 is not provided after the providing of the set condition by the product dispensing sensor 99, then identification of either jammed product 37 or user unretrieved product 37 can be flagged. This flagging can, in turn, be used to provide a signal to a remote location such as at a host computer at a vendor supplier's premises to indicate either jammed product or user unretrieved product and can signal the requirement for an attendant to inspect the vending machine.

It can therefore be seen that the vending machine has a processing means within the computer and a user-operable product selecting means in the form of the various controls on the panel 7. It also has a dispensing mechanism for releasing store product one at a time so that the stored product can be vended. It also has a product sensing means 99 for sensing product dispensed from the dispensing mechanism, and it also has a product removal sensor 105. All of these integers are functionally interconnected with software so that as product is dispensed from the dispensing mechanism in response to user operation of the user-operable product selecting means, the product will be sensed as being dispensed by the product sensing means, and so as product is removed from the vending machine after being dispensed from the dispensing means, it will be sensed by the product removal sensor 105. Whilst a physical product sensing means 99 has been shown in the example above, it should be appreciated that the product sensing means may simply comprise providing a sensing signal in response to user-operable product selecting means being activated to dispense a product and this may conveniently occur at the time when the product is dispensed from the dispensing mechanisms.

The vending machine has a credit card debit facility in association with the card reader 11. The touch monitor screen 9 is interlinked to software within the computer to enable multiple products to be ordered and to be vended by a single transaction on the credit card. Thus, a user will be stepped through a series of order request menus to place multiple product orders for a single transaction which is charged to the credit card. Thus, if product should jam within the machine during dispensing, then the person should not be charged for product not received. In this instance, the software will be invoked on a flagged set condition not being provided by the removal sensor sensing removal of a product from the vending machine. The order will then be terminated without dispensing of subsequent product in that order and the credit card debit will be adjusted to reflect the cost of any product which has been removed from the machine for that order. A receipt will then be printed from the receipt printer 19. Therefore, for dispensing computer printer consumables which are relatively high unit cost items, it is important to accurately debit a client according to the product vended. In other instances of vending machines such as food dispensing vending machines, the unit cost is not of great importance and therefore, in the past, adjustment for non-vended product has not been viewed as being important. However, with the higher unit cost of product and the ability to use a credit card debit system it is important to accurately charge the customer. The present system obviates client or customer dissatisfaction should product be jammed in the machine during vending and thus a feature of this nature adds significantly to the customer perception that use of vending machines for high cost unit items is a normal and reliable activity.

Referring now to FIGS. 10 through 13, there is shown a dispensing mechanism for permitting vending of print media such as reams of printing paper, transparency paper and other media on which print image is to be obtained. These may be quite heavy product relative to the weight of the printing ink cartridges. Here, the media are shown as product 115 and each is generally flat faced with front and back faces 117 and 119 (see FIG. 11). The product 115 has a lower edge 121.

The dispensing mechanism has a storage bin 123 with a generally horizontally extending but inclined floor 125. The product 115 is supported on the floor 125 on its edge 121 so that the flat faces 117 and 119 extend generally upright. The product 115 is also stacked side-by-side and so it can move in a generally horizontal path 127 from an uppermost side of the floor 125 to a lowermost side of the floor 125 by gravity.

Figure 10:
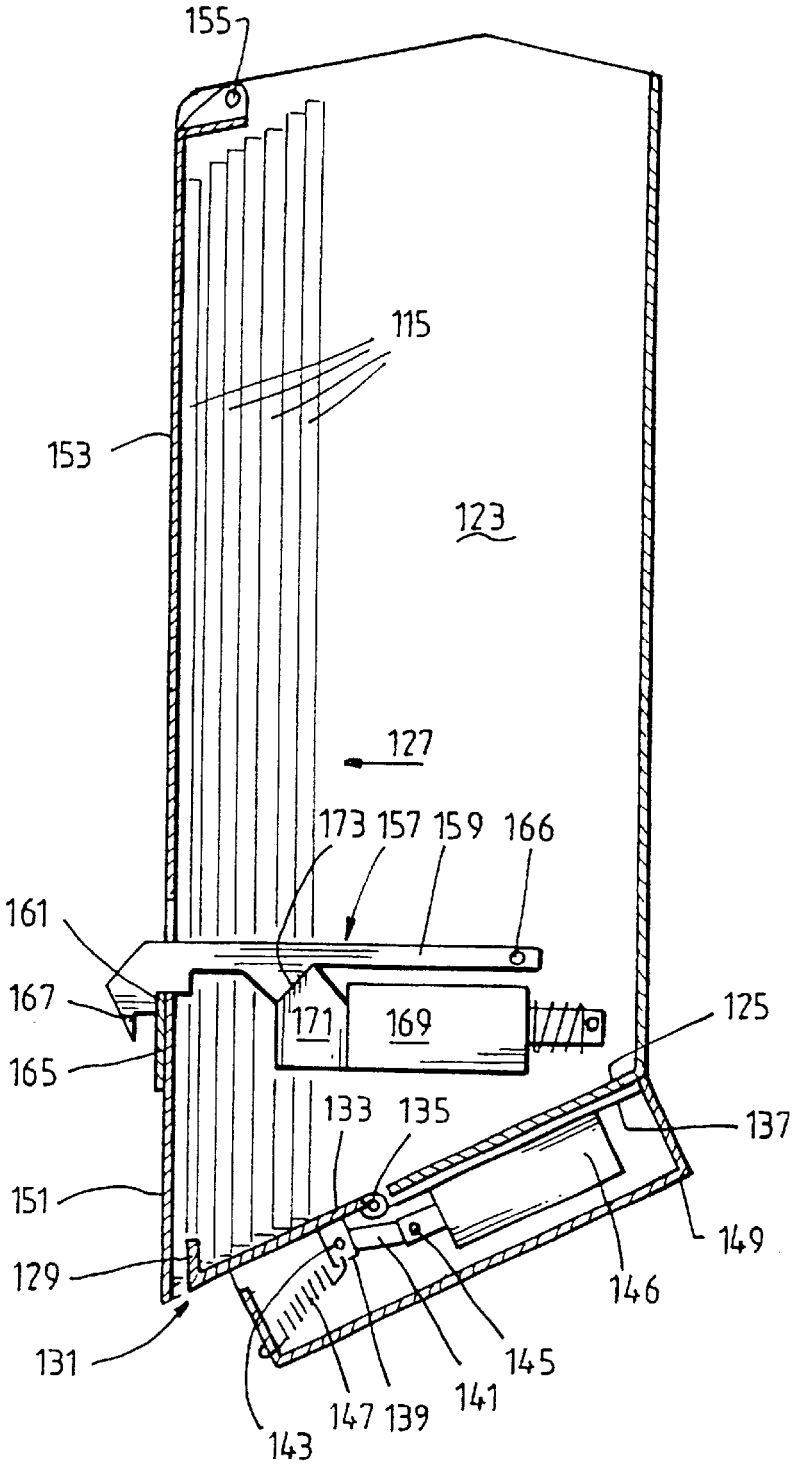
FIGS. 10, 11 and 12 are side views during different stages of operation of a further product discharge mechanism for dispensing media product on which printing is to be made by a computer printer.
Figure 11:
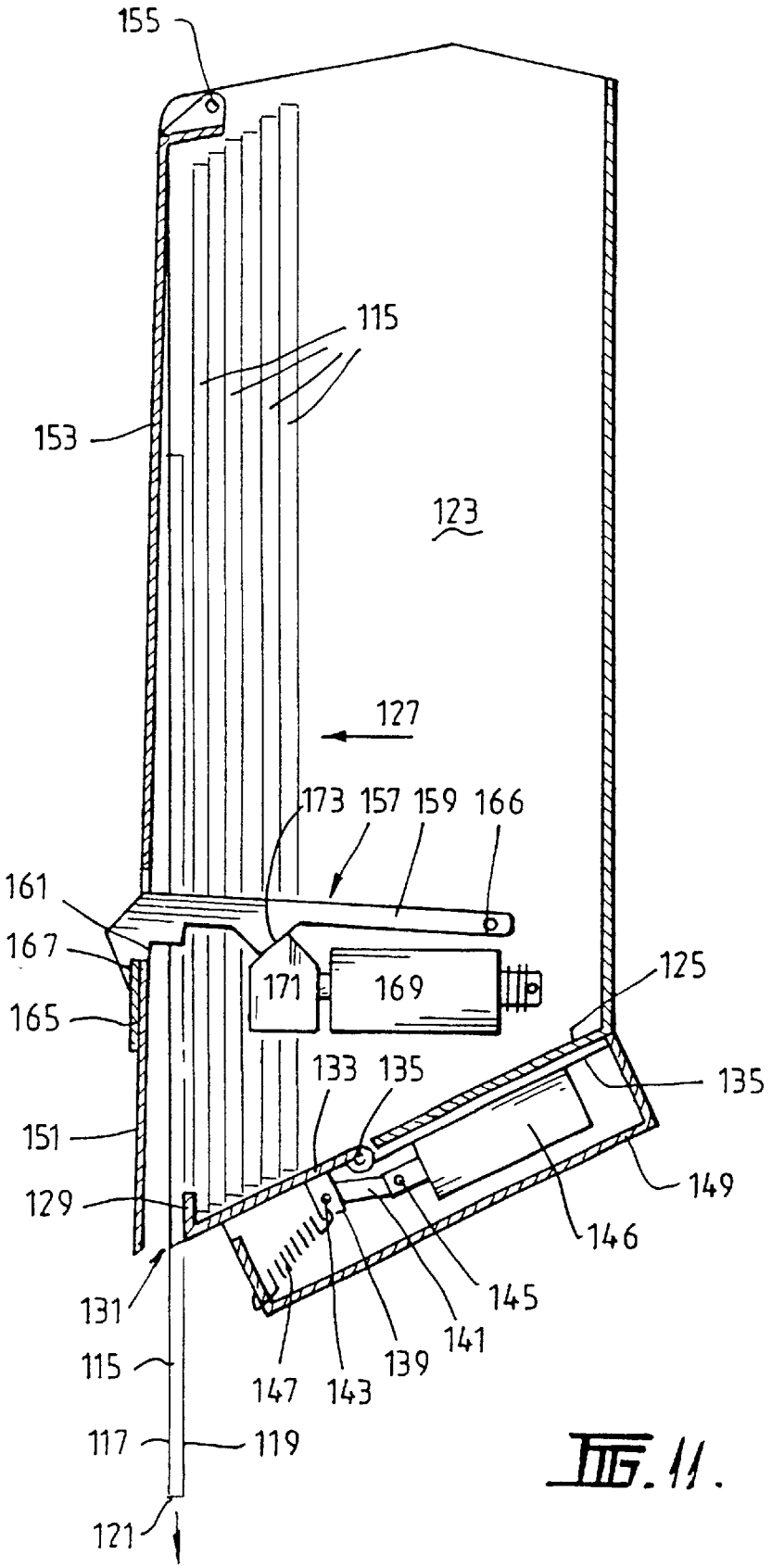
Figure 12:
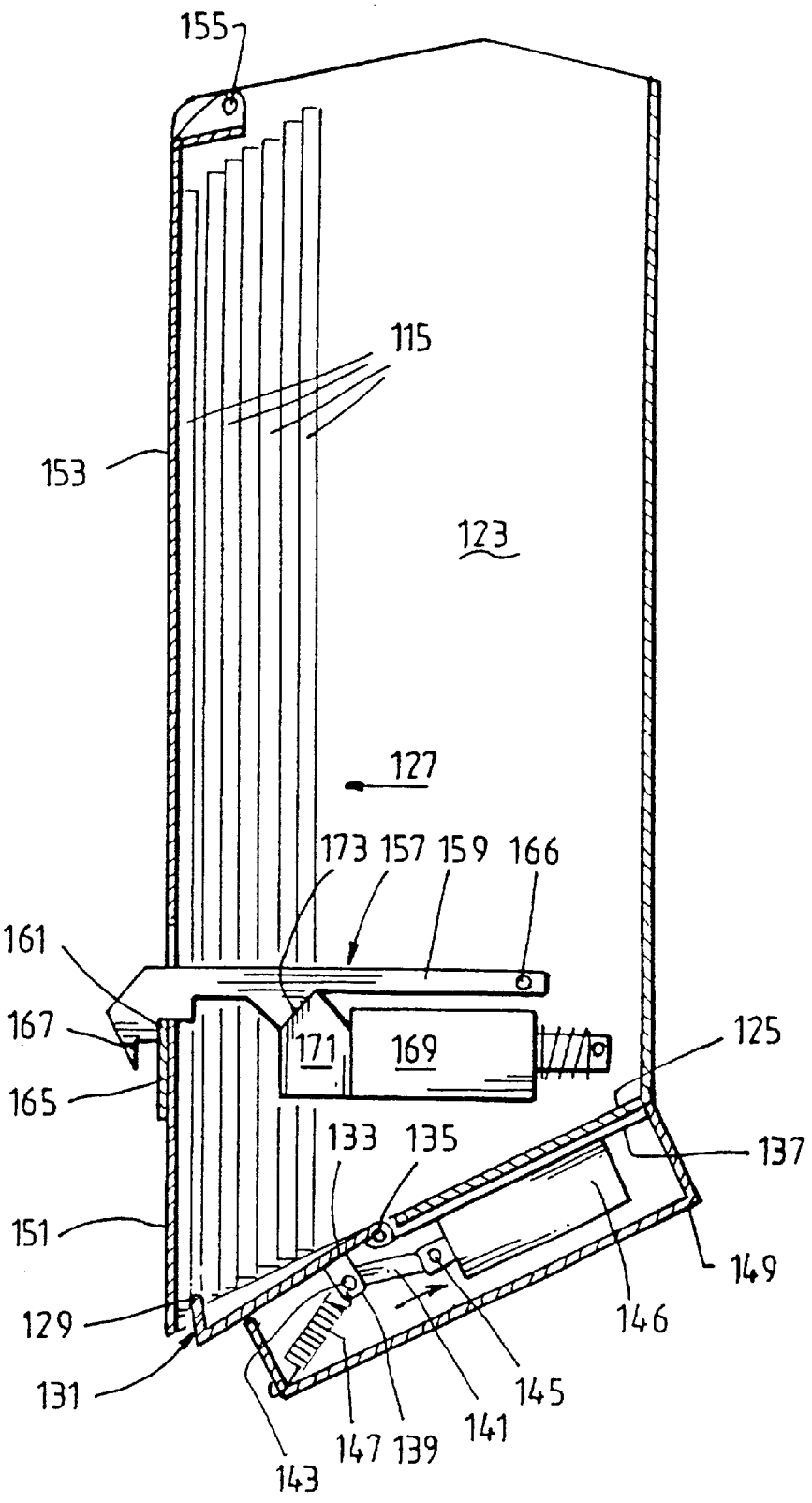

A tongue 129 is mounted to advance and retreat into the path 127 through the floor 125 at the lowermost side 131 of the floor 125. The tongue 129 forms a return fold on an arm 133 (the arm 133 is best seen in FIG. 12). The arm 133 is, in turn, mounted for swinging movement so that the tongue 129 can advance and retreat into the path 125 as it swings. The arm 133 is conveniently attached to a hinge pivot 135 which, in turn, is attached to a base plate 137 which is, in turn, attached to the underneath of the floor 125. An aperture (not shown) is provided in the floor 125 at its lowermost side 131 to enable the tongue 129 to move into and out of the path 127 by being advanced and retreated. The arm 133 has an upstanding lug 139. The lug 139 is used for applying a force to the arm 133 to cause it to swing about the hinge pivot 135. As shown, the lug 139 has a link arm 141 pivotally connected thereto at pivot 143. The link arm 141 is, in turn, pivotally connected to a solenoid-operated plunger by pivot 145. The solenoid plunger is, in turn, operated by a solenoid 146. Spring means 147 urges the tongue 129 to a position where it is advanced into the path 127. The spring means 147 connects with an outer casing part 149 of the base 137 and with the pivot 143. Thus, in FIGS. 10, 11 and 12, the force applied by the spring means 147 is clockwise. When the solenoid is in a static condition and not operated, the plunger is in an extended position as shown in FIGS. 10 and 11. However, when power is applied to the solenoid 146, the plunger is retracted which, in turn, causes a force to be applied to the lug 139 to swing the arm 133 and the tongue 129 in an anti-clockwise direction. This movement is shown by the arrow in FIG. 12. When power is disconnected from the solenoid 146, the plunger is returned to the extended position which, in turn, permits the tongue 129 to be advanced into the path 127.

A movable stop 151 is provided at the end of the floor at the lowermost side 131. In this embodiment, the stop 151 comprises an end wall 153 of the bin 123. The stop 151 is movable and in the particular embodiment it is movable by swinging from an upper pivot 155. Here it can swing from a position where it is at the end of said floor 125, as shown in FIG. 10, to a position where it is away from the floor 125, as shown in FIG. 11. The stop 151 and the tongue 129 define a space (not shown by number in the drawings to add clarity) between the stop 151 and the tongue 129 such that a single product can be supported on the floor in that space and be prevented from falling by gravity from the floor by the stop 151. This is shown in FIG. 10 and also in FIG. 12. The tongue 129 then acts to prevent movement of the next product 115 in the path 127. When product 115 is to be vended, the stop 151 is moved away from the lowermost side 131 of the floor 125. In this embodiment, the stop 151 is allowed to swing about the pivot 155 as shown in FIG. 11. In other embodiments where the stop 151 needs to be physically moved by some moving means, then the moving means is operated. The product 115 then falls by gravity from the end of the floor 125 allowing the product 115 to be vended. The tongue 129 therefore holds all further product 115 in the path 127. The stop 151 is then moved to the lowermost side 131 of the floor 125 either by allowing it to return swing as shown in this embodiment or by physically moving the stop 151 by moving means.

In this embodiment, the stop 151 and the end wall 153 are retained by a latch means 157. The latch means 157 has a latch arm 159 with a latch face 161. The latch arm 159 is pivoted to a side wall 163 of the bin 123 by pivot pin 166. The stop 151 carries a bar 165 which extends across the width of the wall 153 past the side walls 163 (see FIG. 13). Thus, when the stop 151 is held in the position against the lowermost side 131 of the floor 125, the bar 165 is located against the latch face 161. When the stop means 151 is to be moved away from the lowermost side 131 of the floor 125, the latch bar 159 is moved upwardly thereby releasing the latch face 161 from the latch bar 165 and allowing movement away from the lowermost side 131. The latch bar has a stop face 167 for limiting the particular extent of movement of the stop 151. The latch bar is caused to be moved to release latching by means of a solenoid 169 which operates the solenoid plunger to move a latch cam 171 to operate against a latch cam face 173 to, in turn, cause upward swinging motion of the latch arm 159 as shown in FIG. 11. Thus, a lateral displacement of the latch cam 171 causes it to engage with the latch cam face 173 which, in turn, raises the latch arm 159 to release the latch bar 165 from the latch face 161. The upward movement of the latch arm 159 is restricted so that as the stop 151 moves away from the lowermost side 131 of the floor 125 it is stopped by the stop face 167.

Figure 13:
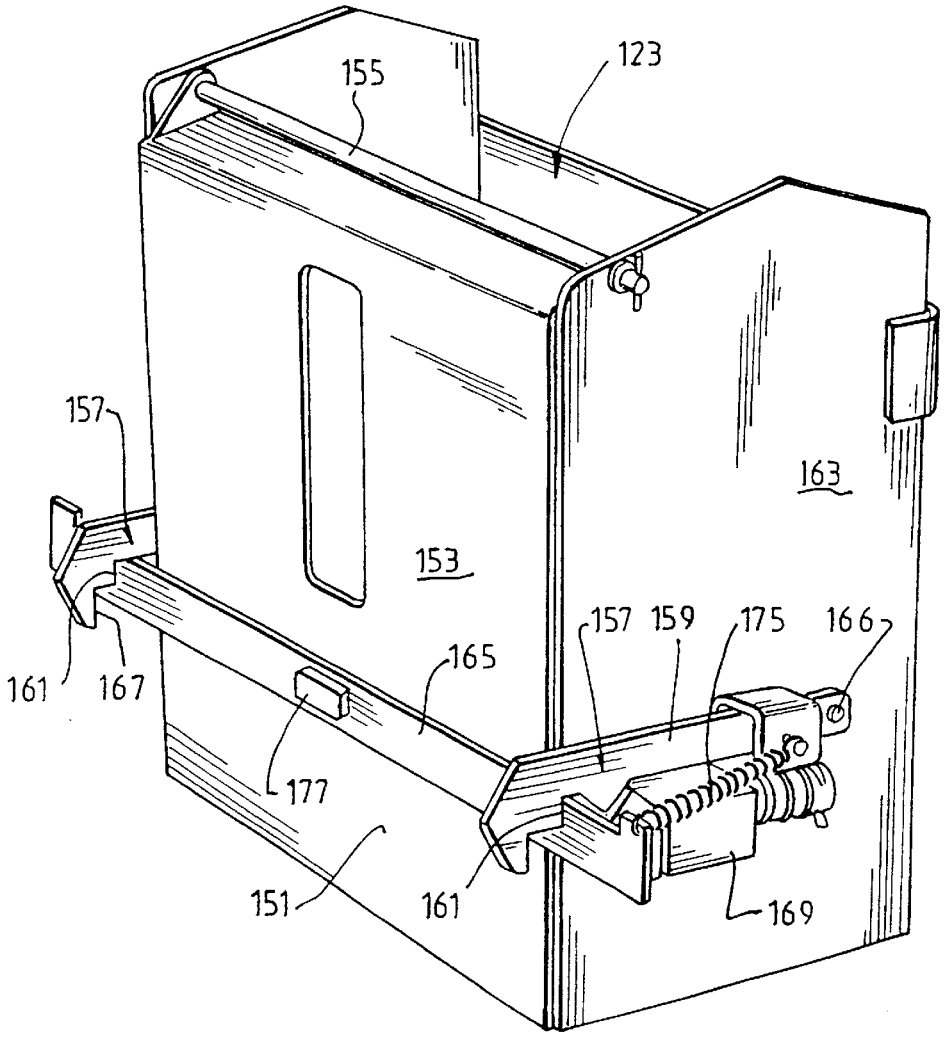
FIG. 13 is a perspective view of the mechanism of FIGS. 10, 11 and 12.

When the product 115 has been vended by falling off the lowermost side 131 of the floor 125, the solenoid 169 can be released and the latch cam 171 returned to its original position shown in FIGS. 10 and 12. The latch arm 159 is then able to fall by gravity to the generally horizontally extending position shown in FIGS. 10 and 12. Coupled with this movement is a corresponding movement of the stop 151 as it is again moved to the end of the lowermost side 131 of the floor 125. FIG. 11 clearly shows that when the stop 151 is moved away from the lowermost side 131 of the floor 125 it is inclined from vertical. Thus, the stop 151 can, in this embodiment, swing by gravity back to a vertically extending position where it is adjacent the end of the lowermost section 131 of the floor 125. The latch arm 159 therefore enables relatching of the latch face 161 behind the latch bar 165 and hold the stop 151 against the lowermost end of the floor 125. Spring means may be provided on the latch arm 159 to assist returning to this position. In addition, spring means may be provided on the stop means 151 to assist returning to this position. Thus, it should be appreciated that when the stop means 151 is moved away from the lowermost side 131 of the floor 125, a product 115 can slide further down the floor defining that space between the stop 151 and the tongue 129. The weight of the product 115 also assists in the movement of the stop 151 for this purpose. FIG. 13 shows spring means 175 for urging the stop 151 to the position where it is at the end of the lowermost section 131 of the floor 125. FIG. 13 also shows similar latch means 157 on each side of the bin 123.

Because the tongue 129 and the associated components comprising the solenoid 145 are mounted on a base plate 137, the tongue 129 is readily adapted to be moved along the length of the floor 125. For this purpose, elongated slots (not shown) may be provided with appropriate bolts and nuts used for locating and then holding the base 137 in a required position to, in turn, position the tongue 129 at a required distance from the stop 151 to accommodate for particular thicknesses of product 115. Thus, by appropriately sliding the base 137 relative to the floor 125, the tongue 129 can be positioned relative to the stop 151 to accommodate for changes of product size to be held within the bin 123. No further changes are required to the stop 151 or the latch means 157. This provides an economical means of changing product 115 size within the bin 123 as customer needs for new product lines change.

FIG. 13 shows a product sensor 177 mounted on the back of bar 165. The product sensor 177 can comprise an LED transmitter and a similar pick-up transducer which receives reflections off a product held within the space between the stop 151 and the tongue 129. This sensor 177 can be used to signal exhaustion of stock from the bin 123, and also dispensing of the stock 115 from the dispensing mechanism. A suitable aperture may be provided within the wall 153 to permit the required light beams to pass therethrough for such sensing.

In use, when a product has been dispensed, and the stop 151 returned to the lowermost section 131 of the floor 125, the tongue 129 can be retreated from the path 127 thereby allowing all remaining products 115 to move by gravity towards the stop 151. When the next product to be dispensed butts against the stop 151, the tongue 129 can then be advanced into the path 127 between that product 115 and the next product 115 thereby holding that next product and all further product from further movement in the path 127. The dispensing mechanism is therefore ready for dispensing of a further product 115.

A product removal sensor (not shown) is provided at an appropriate position near slot 27 for sensing product removal and for setting a similar flag condition to that as product removal sensor 99 of the previously described dispensing mechanism.

Figure 14:
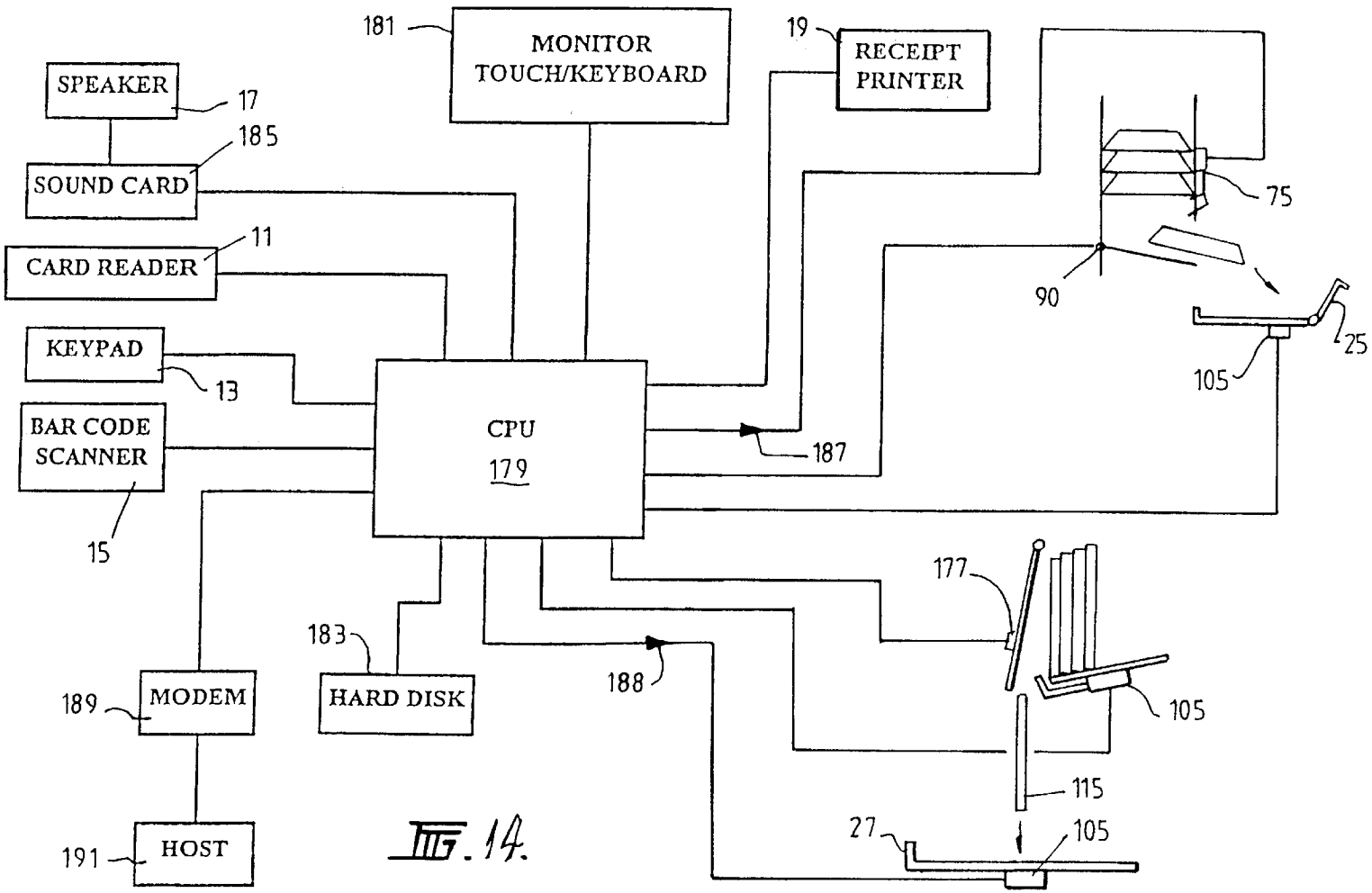
FIG. 14 is a schematic electrical block circuit diagram of the components.

FIG. 14 shows a block schematic diagram of the basic electrical components within the vending machine. Here, a computer such as an industrial PC is provided and this is represented by a CPU 179, touch screen monitor/keyboard 181, hard disk 183 and a sound card 185. The speaker 17 is, in turn, connected to the sound card 185. The card reader 11, keypad 13, bar code scanner 15 and receipt printer 19 are connected with the CPU 179 via suitable interfaces (not shown). Solenoid driver circuits 187 and 188 are also connected with the CPU 179 to drive the respective solenoids 75 and 145, of the inkjet printer cartridge dispenser and the media dispenser respectively. Connections are also made with the CPU 179 for the sensors 99 and 105. Similar connections are made for the sensor 177. A modem 189 is also connected with the CPU 179 to, in turn, make connection with a host computer 191 at a vending machine supplier's headquarters.

Suitable software is loaded within the computer to permit vending of product from the vending machine.

Figure 15:
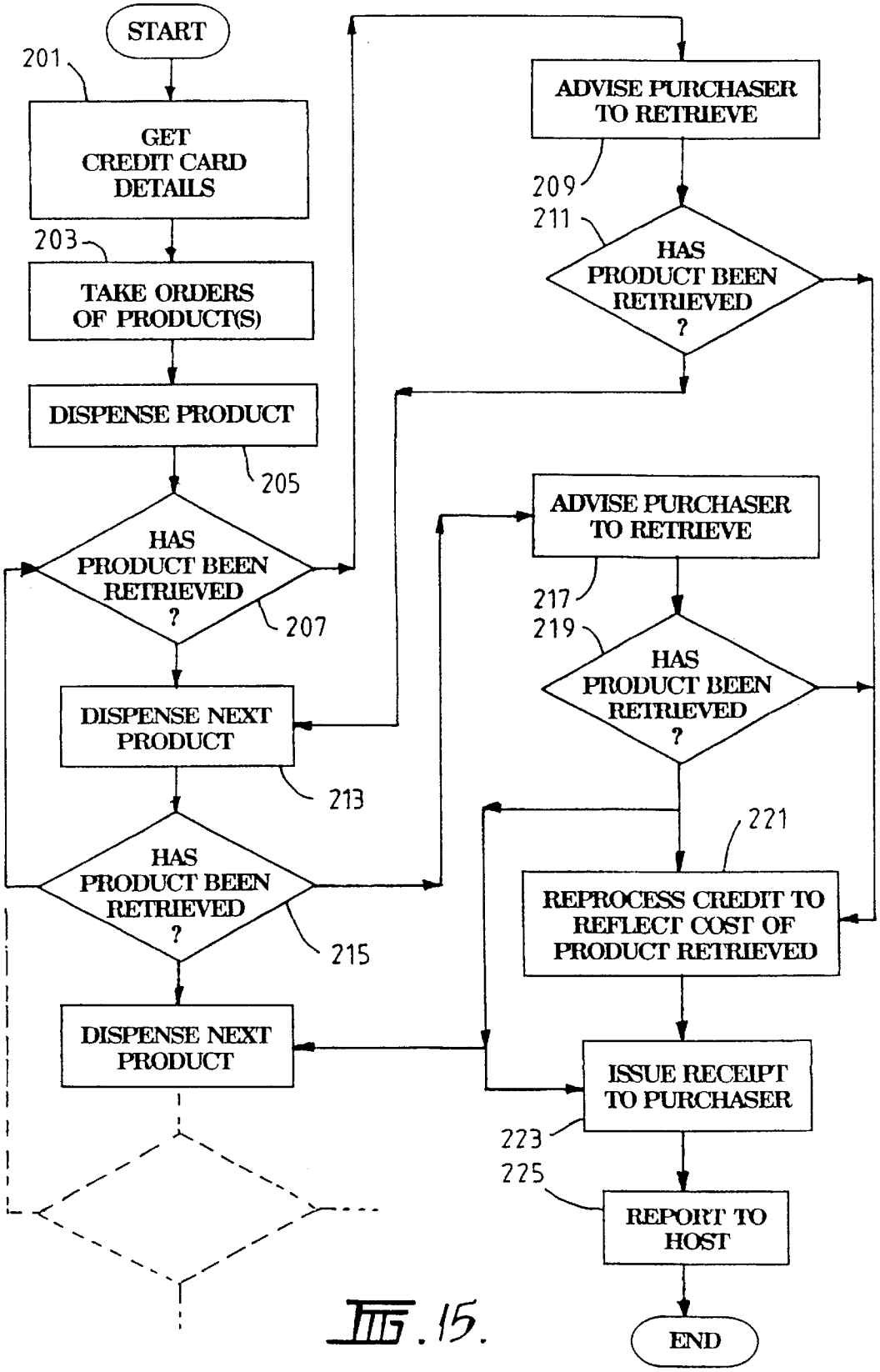
FIG. 15 is a software flow diagram showing functionality of part of the software in the machine.

FIG. 15 shows the particular functionality of part of the software program. The first step represented by action 201 is to obtain credit card details from a credit card inserted by a user through the card reader 11. At this point of time, the monitor screen 9 will be invoked to show the need to insert the user's PIN through the PIN pad 13. Typically, the PIN pad 13 is a secure PIN pad so that the user's PIN cannot be fraudulently detected. The modem 189 is invoked to make a connection with the host 191 to, in turn, make connection with the credit card provider. Alternatively, the modem 189 may make direct connection with the credit card provider. The monitor screen is then placed in a mode to display the possible choices for orders in the machine. The user then places an order either by direct entry through touching appropriate parts of the screen 9 or by bar code scanning an existing product(s) with the bar code scanner 21. This is represented by action 203. When the order has been placed, for one or many products in a particular transaction for the credit card, then the machine is put into a routine to dispense product one at a time. This is represented by action 205. As product is dispensed one at a time from the dispensing mechanisms, the appropriate dispensing sensors 99 and 177 will operate to, in turn, set a flag condition within the CPU 179. Thus, as product is retrieved or removed the appropriate removal sensors 105 will be activated. Once activated, the next product in the order can be dispensed. If product is not removed, then the software is invoked to signal either jammed product or unretrieved product. This is shown functionally by actions 207, 209 and 211. It is that action 209 can display a message on the screen 9 or an audible announcement through the loudspeaker 17 to request the purchaser to retrieve/remove the dispensed product. When the product is removed, the next product is dispensed as represented by action 213. The above process is repeated by actions 215, 217 and 219, etc. for the number of products requested in the order. If any one of the actions 211 and 219, etc. do not result in the product being sensed as being retrieved/removed, then action 221 is invoked to reprocess the credit card transaction to reflect the cost of product which may have already been retrieved/removed. After this event, a receipt is then printed to the purchaser by action 223. A report can then be made to the host in action 225 to indicate the possible likelihood of product being jammed within the machine after being dispensed by the dispensing mechanism.

In the event of a malfunction sensed as a result of product not being retrieved/removed, the screen 9 may be arranged to display a message such as NOT IN USE and the location of the nearest alternative vending machine.

Modifications may be made to the invention as would be apparent to persons skilled in the art of producing vending machines.

Figure 16:
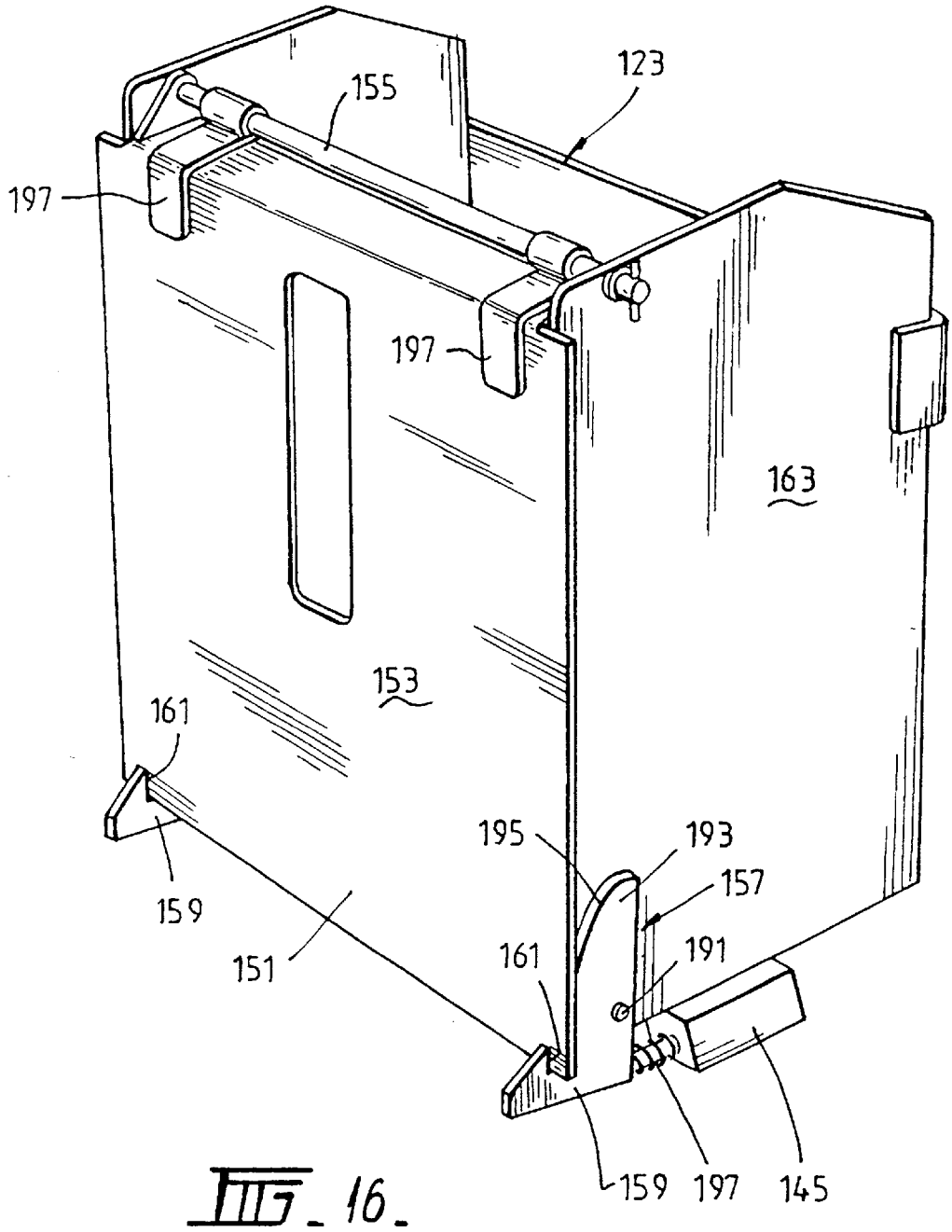
FIG. 16 is a view similar to that of FIG. 13 but showing an alternative embodiment.
Figure 18:
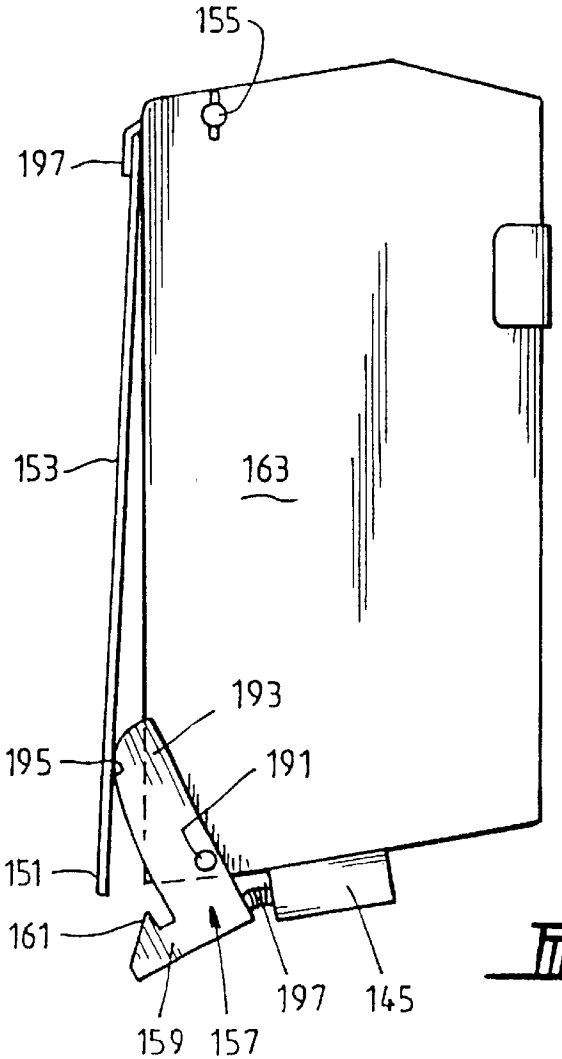
FIGS. 17 and 18 are views similar to FIGS. 11 and 12 but of the embodiment of FIG. 16.
Figure 17:
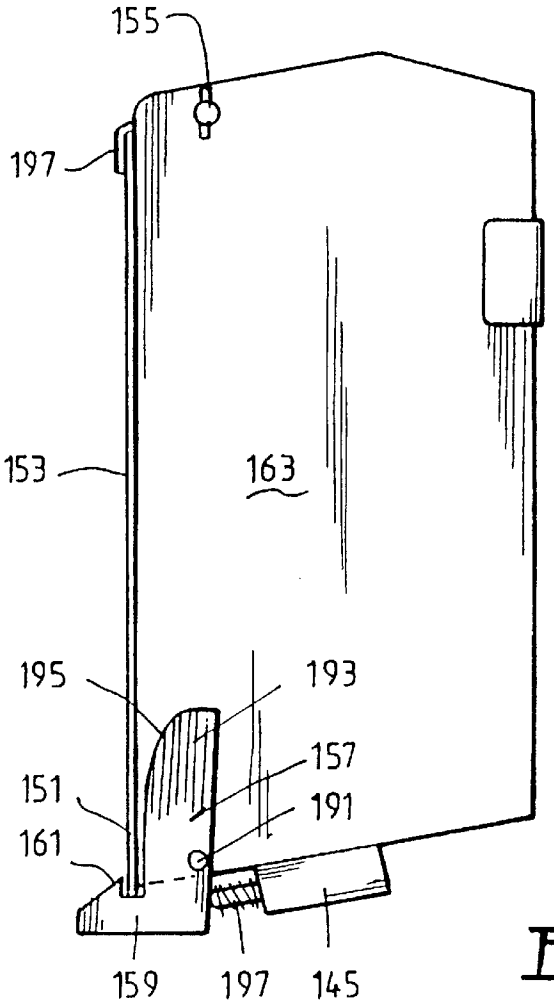

Referring now to FIGS. 16, 17 and 18 there is shown a modification to the latch means 157 in FIGS. 10 through 13. Here, the latch means is mounted to catch a lowermost face of the end wall 153 of the stop 151. The end wall 153 extends past the side walls 163 of the bin 123. In this case, the latch arms 159 are mounted on pivot axles 191 so that the latch arms 159 can swing on operation of the solenoids 145. Thus, there are a pair of latch means 157 comprising latch arms 159 which are mounted with one on one end wall 163 and the other on the other end wall 163. As the latch arms 159 swing counterclockwise as shown in the Figures, the latch face 161 releases from the stop 151 and allows it to swing, as particularly shown in FIG. 18. The latch arm 159 has an extending arm 193 with a curved face 195. The curved face 195 engages with the end wall 153 in the overhang portions which extend past the end walls 163, and pushes the end wall 153 to the open position. Spring means 197 biases the latch arms 159 to the latching position as shown in FIGS. 16 and 17. Operation is otherwise the same as in the previously described embodiment. Thus, when the latch arms 159 returns to the position shown in FIG. 17 by rotating clockwise under the influence of the spring means 197, the latch face 161 locates behind the stop 151 and moves with it to the closed position.

FIG. 16 shows two leaf springs 197 which pass around the upper pivot 155 and bias the end wall 153 to the closed position. Thus, when the solenoid 145 is retracted causing the latch arm 159 to swing counterclockwise, the solenoid 155 overcomes the spring bias forces of the leaf springs 197. When power is removed from the solenoid 145, the leaf springs 197 assist returning of the end wall 153 to the closed position so that the latch face 161 locates therebehind and holds the end wall 153 closed.

These and other modifications may be made without departing from the ambit of the invention, the nature of which is to be determined from the aforegoing description.

What is claimed is:

1. A dispensing mechanism for a vending machine for permitting generally flat faced products to be vended one at a time, said mechanism comprising:

an upright storage chute in which identical shaped and sized products can be stacked one on top of the other so a flat face of said generally flat faced product lies generally transversely of vertical, said storage chute being defined by a first generally upright extending wall and a spaced and opposed second generally upright extended wall, the spacing being sufficient to allow the products to move in a generally vertical path in said chute by gravity from the top to the bottom of the chute;

an inclined product discharge ramp extending downwardly across said chute towards a product discharge opening in said second wall;

a first tongue and a vertically lower spaced second tongue mounted to advance and retreat into said path through said second wall at the bottom of the stack, a lowermost product being supported in said chute by a support surface in said path opposite where said first tongue extends through said second wall and by said first tongue when said first tongue is advanced into said path through said second wall, the weight of all products being carried by said support surface and said first tongue;

movement means to permit said second tongue to retreat when said first tongue is advanced, and to permit said second tongue to be advanced when said first tongue is retreated, so said second tongue will catch a lowermost edge of the lowermost product as it falls past said first tongue when said first tongue is retreated and so said lowermost product will then be supported in said chute by said support surface and by said second tongue, the vertical spacing of said first tongue and said second tongue being such that when the lowermost product is caught by the second tongue, the next highermost product in the stack will be positioned so that the first tongue can be advanced under that product so that that product and all products thereabove will be carried by said upper part of said inclined ramp and said first tongue, and so as said second tongue is retreated the product caught on said second tongue will fall by gravity onto said inclined ramp and pass through said discharge opening and be vended; and a solenoid connected to said first tongue and to said second tongue to effect said advancing and retreating.

2. A mechanism as claimed in claim 1 wherein said first tongue and said second tongue are mechanically interconnected for pivoting rocking movement for advancing and retreating, said pivot axis being generally horizontal.

3. A mechanism as claimed in claim 1 wherein said support surface is an upper part of said inclined ramp.

4. A mechanism as claimed in claim 3 wherein said inclined ramp has a step so that a product supported by said first tongue will be supported at an upper part of said step, and a product supported by said second tongue will be supported at a lower part of said step.

5. A mechanism as claimed in claim 1 wherein said storage chute is one of a plurality of chute modules, and that each module is positioned one above the other to form a multiple module height chute so that a plurality of different products can be stacked in said multiple height chute and vended therefrom by advancing or retreating the appropriate first and second tongues.

6. A mechanism as claimed in claim 5 wherein said multiple height chute is a single chute with bays for each module and wherein the plurality of discharge openings is coverable by respective removable wall plates, and that said plurality of first tongues and said second tongues are removable, and that said inclined ramps are removable, whereby a product vendor can choose to utilise the whole of the chute for one group of products in a range, or can utilise the chute for a plurality of different product groups in a range, thereby permitting multiple groups of products to be stacked in said chute and user selected for vending by operation of the corresponding first tongue and second tongue.

7. A mechanism as claimed in claim 1 wherein said inclined ramp is of unitary construction.

8. A mechanism as claimed in claim 1 wherein said ramp is two or more separate items.

9. A mechanism as claimed in claim 8 wherein there is a first item which defines the upper part of said ramp and a second or more items which define a lower part so the first item may extend from or adjacent said first wall and the second item may extend from or adjacent a lower part of said upper part of said ramp.

10. A mechanism as claimed in claim 1 wherein said inclined ramp is swingable about its upper region so that when loading fresh products into said chute, said ramp can be swung by its lowermost part swinging upwardly to a generally horizontal position thereby closing the chute at the bottom of the chute and inhibiting against a mis-oriented product falling through the chute and being discharged from said product discharge opening.

11. A vending machine comprising:

a plurality of chute modules, each module having an upright extending chute in which identical shaped and sized products can be stacked one on top of the other, said storage chute being defined by a first generally upright extending wall and a spaced and opposed second generally upright extending wall, the spacing being sufficient to allow the products to move in a generally vertical path in said chute by gravity from the top to the bottom of the chute;

an inclined product discharge ramp extending across the bottom of the chute extending downwardly from adjacent the first wall to the second wall;

a product discharge opening in said second wall; and a product dispensing mechanism at the bottom of the chute above said ramp, said product dispensing mechanism permitting the lowermost product in said chute to be vended by moving onto said ramp and passing through said opening whilst retaining all products higher than said lowermost product within said chute for subsequent vending, wherein each module is positioned one above the other to provide a multiple module height chute so that a plurality of different products can be stacked in said multiple height chute and vended therefrom by advancing or retreating the appropriate first and second tongues, and wherein said multiple height chute is a single chute with bays for each module and wherein the plurality of discharge openings are coverable by respective removable wall plates, said plurality of first tongues and said second tongues are removable, and that said inclined ramps are removable, whereby a product vendor can choose to utilise the whole of the chute for one group of products in a range, or can utilise a chute for a plurality of different product groups in a range, thereby permitting multiple groups of products to be stacked in said chute and user selected for vending by operation of the corresponding first tongue and second tongue.

12. A vending machine comprising:

a plurality of chute modules, each module having an upright extending chute in which identical shaped and sized products can be stacked one on top of the other, said storage chute being defined by a first generally upright extending wall and a spaced and opposed second generally upright extending wall, the spacing being sufficient to allow the products to move in a generally vertical path in said chute by gravity from the top to the bottom of the chute;

an inclined product discharge ramp extending across the bottom of the chute extending downwardly from adjacent the first wall to the second wall;

a product discharge opening in said second wall; and a product dispensing mechanism at the bottom of the chute above said ramp, said product dispensing mechanism permitting the lowermost product in said chute to be vended by moving onto said ramp and passing through said opening whilst retaining all products higher than said lowermost product within said chute for subsequent vending, wherein each module is positioned one above the other to provide a multiple module height chute so that a plurality of different products can be stacked in said multiple height chute and vended therefrom by advancing or retreating the appropriate first and second tongues, and wherein said ramp is swingable about its upper region so that when loading fresh products into said chute, said ramp can be swung from its lowermost part upwardly to a generally horizontal position thereby closing the chute at the bottom of the chute and inhibiting against a mis-oriented product falling through the chute and being discharged from said product discharge opening.

13. A dispensing mechanism for a vending machine for permitting generally flat faced products to be vended one at a time, said mechanism comprising;

a storage bin with a generally horizontally extending but inclined floor on which said generally flat faced products can be supported on an edge face so that a flat face extends generally upright and wherein products can be stacked side-by-side, and wherein the product can move in a generally horizontal path across said floor by gravity from an uppermost side of said floor to a lowermost side of said floor;

a tongue mounted to advance and retreat into said path through said floor at the lowermost side of said floor; and a movable stop at the end of the floor at the lowermost side, wherein the spacing between said tongue and said stop is such that a single product can be supported on the floor in said space and prevented from falling by gravity from said floor by said stop, and wherein said tongue is advanceable into said path to prevent movement of the next product in said path, so that when a product is to be vended said stop can be moved away from the end of the floor thereby allowing the product to fall by gravity and to be vended, and so that after vending said stop can be returned to the end of the floor and the tongue retreated thereby allowing the next product to move into said space between said tongue and said stop whereupon said tongue can then be advanced between the next product and the succeeding product making the machine ready for future vending;

wherein said movable stop is an end wall of said storage bin;

wherein said end wall is pivoted near the top of said storage bin so it can swing from a position where it is at the end of said floor to a position away from said floor; and wherein there is a latch for holding said end wall at the position where it is at the end of said floor and wherein when said latch is released, the weight of product will cause said end wall to swing to said position away from floor and allow the product to fall by gravity off said floor, and wherein said latch can relatch said end wall as it return swings to the end of said floor.

14. A mechanism as claimed in claim 13 wherein the end wall is mounted so it return swings by gravity.

15. A vending machine for vending products comprising:

a housing having a delivery bin;

a processor;

a user operable selector to select a desired product, said user operable selector providing an input to said processor;

a dispensing mechanism to deliver products stored within said housing to said delivery bin, said dispensing mechanism being controlled by said processor; and a product removal sensor, adjacent said delivery bin, providing an input to said processor, said product removal sensor sensing a physical removal of a dispensed product from said delivery bin.

16. The vending machine according to claim 15, further comprising:

a dispensing sensor sensing the release of a product by said dispensing mechanism to travel to said delivery bin, said dispensing sensor providing an input to said processor.

17. The vending machine according to claim 16, wherein said dispensing sensor senses the release of a product by said dispensing mechanism by monitoring a dispensing path existing between said dispensing mechanism and said delivery bin.

18. The vending machine according to claim 17, wherein said dispensing sensor includes a light emitting element and a light receiving element positioned adjacent said dispensing path to interact with a dispensed product.

19. The vending machine according to claim 16, wherein said dispensing sensor senses the release of a product by said dispensing mechanism by monitoring activation of said dispensing mechanism.

20. The vending machine according to claim 15, wherein said user operable selector is operable to select multiple desired products during a single purchase transaction, wherein said dispensing mechanism is operable to sequentially deliver said multiple desired products, and wherein if said product removal sensor determines that a dispensed product is not removed from said delivery bin, said processor stops said dispensing mechanism from dispensing subsequent desired products.

21. The vending machine according to claim 20, further comprising:

a card reader providing an input to said processor, wherein said card reader can accept payment for the multiple desired products of the single transaction, and wherein if said product removal sensor determines that a dispensed product is not removed from said delivery bin, said processor causes the customer to be charged for only those products removed from the delivery bin.

22. The vending machine according to claim 21, wherein said card reader is a credit card reader and wherein said processor initially charges a customer's account for all of the desired products selected via the user operable selector, and then subsequently credits the customer's account for products not dispensed to, or retrieved from, said delivery bin.

23. The vending machine according to claim 15, wherein said product removal sensor includes a light emitting element and a light receiving element positioned adjacent said delivery bin to interact with a product in said delivery bin.

24. The vending machine according to claim 15, wherein if said product removal sensor fails to sense a physical removal of a dispensed product from said delivery bin, said processor causes a visual or audible alert to be issued to the user to remind the user to remove the product in the delivery bin.

25. The vending machine according to claim 24, wherein if the user fails to remove the dispensed product from said delivery bin for a predetermined period of time, said processor causes a visual or audible alert to be issued to an authorized attendant at a remote location that the vending machine needs to be inspected.

26. A vending machine for vending products comprising:

a housing having a delivery bin;

a processor;

a user operable selector to select a desired product, said user operable selector providing an input to said processor;

a dispensing mechanism to deliver products stored within said housing to said delivery bin, said dispensing mechanism being controlled by said processor;

a sensor providing an input to said processor, said sensor sensing a dispensing of a product by said dispensing mechanism or a removal of a dispensed product from said delivery bin; and a payment acceptor providing an input to said processor, wherein if said processor determines that a selected product is not dispensed or removed from said delivery bin, said processor credits the customer.

27. The vending machine according to claim 26, wherein said payment acceptor is a card reader for reading credit cards and wherein said processor initially charges a customer's account for a product selected via the user operable selector, and then subsequently credits the customer's account if the selected product is not dispensed to, or retrieved from, said delivery bin.

28. The vending machine according to claim 26, wherein said sensor is a dispensing sensor sensing the release of a product by said dispensing mechanism to travel to said delivery bin.

29. The vending machine according to claim 26, wherein said sensor is a product removal sensor sensing a physical removal of a dispensed product from said delivery bin.

* * * * *